US008957836B2

(12) United States Patent
Koyama et al.

(10) Patent No.: US 8,957,836 B2
(45) Date of Patent: Feb. 17, 2015

(54) METHOD FOR DRIVING LIGHT-EMITTING DEVICE

(75) Inventors: Jun Koyama, Sagamihara (JP); Mitsuaki Osame, Atsugi (JP); Yu Yamazaki, Setagaya (JP); Aya Anzai, Tsukui (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1533 days.

(21) Appl. No.: 11/730,617

(22) Filed: Apr. 3, 2007

(65) Prior Publication Data

US 2007/0177088 A1 Aug. 2, 2007

Related U.S. Application Data

(62) Division of application No. 10/844,401, filed on May 13, 2004, now Pat. No. 7,218,294.

(30) Foreign Application Priority Data

May 16, 2003 (JP) ..... 2003-139457
Jun. 3, 2003 (JP) ..... 2003-157599

(51) Int. Cl.
*G09G 3/30* (2006.01)
*G09G 3/32* (2006.01)

(52) U.S. Cl.
CPC ..... *G09G 3/3233* (2013.01); *G09G 3/3266* (2013.01); *G09G 3/3291* (2013.01); *G09G 2300/0426* (2013.01); *G09G 2300/0814* (2013.01); *G09G 2300/0842* (2013.01); *G09G 2300/0861* (2013.01); *G09G 2300/0866* (2013.01); *G09G 2310/0251* (2013.01);

(Continued)

(58) Field of Classification Search
USPC ..... 345/76–84; 315/169.1–169.3; 313/483–507
See application file for complete search history.

(56) References Cited

U.S. PATENT DOCUMENTS 5,969,474 A * 10/1999 Arai ..... 313/504
6,137,223 A * 10/2000 Hung et al. ..... 313/506
6,742,762 B2 6/2004 Koyama (Continued)

FOREIGN PATENT DOCUMENTS

EP 1607931 12/2005
JP 2003-005710 A 1/2003

(Continued)

*Primary Examiner* — Rodney Amadiz
(74) *Attorney, Agent, or Firm* — Eric J. Robinson; Robinson Intellectual Property Law Office, P.C.

(57) ABSTRACT

A light emitting device capable of suppressing drop in luminance or luminance unevenness of a light emitting element due to deterioration of an electro luminescent material and capable of switching an image direction vertically to horizontally without a frame memory additionally provided. The light emitting device of the invention comprises in each pixel first to fourth transistors, a light emitting element, and a signal line. The first transistor and the second transistor control the connection between the signal line and a gate of the third transistor, the fourth transistor controls a current value supplied to the light emitting element, and the third transistor selects whether the current is supplied to the light emitting element or not. Further, the first transistor and the second transistor are switched separately.

40 Claims, 18 Drawing Sheets

(52) U.S. Cl.
CPC ..... *G09G2320/0223* (2013.01); *G09G 2320/0233* (2013.01); *G09G 2340/0492* (2013.01)
USPC ..... 345/76

(56) References Cited

U.S. PATENT DOCUMENTS

| | | | | |
|---|---|---|---|---|
| 6,753,654 | B2 | 6/2004 | Koyama | |
| 6,774,877 | B2 | 8/2004 | Nishitoba et al. | |
| 6,798,405 | B2 | 9/2004 | Anzai | |
| 6,809,482 | B2 | 10/2004 | Koyama | |
| 6,864,628 | B2 | 3/2005 | Yamazaki et al. | |
| 6,909,240 | B2 | 6/2005 | Osame et al. | |
| 6,909,242 | B2 | 6/2005 | Kimura | |
| 7,042,162 | B2 | 5/2006 | Yamazaki et al. | |
| 7,079,093 | B2 * | 7/2006 | Sun | 345/82 |
| 7,138,967 | B2 | 11/2006 | Kimura | |
| 7,141,934 | B2 | 11/2006 | Osame et al. | |
| 7,173,586 | B2 | 2/2007 | Osame et al. | |
| 7,358,942 | B2 | 4/2008 | Yamazaki et al. | |
| 7,714,818 | B2 | 5/2010 | Osame et al. | |
| 2001/0015618 | A1 * | 8/2001 | Yamazaki et al. | 313/505 |
| 2001/0044035 | A1 * | 11/2001 | Morii | 428/690 |
| 2002/0196212 | A1 * | 12/2002 | Nishitoba et al. | 345/76 |
| 2003/0045043 | A1 * | 3/2003 | Koyama | 438/200 |
| 2003/0117352 | A1 | 6/2003 | Kimura | |
| 2004/0251953 | A1 | 12/2004 | Yamazaki et al. | |
| 2004/0252565 | A1 | 12/2004 | Yamazaki et al. | |
| 2004/0263066 | A1 | 12/2004 | Abe et al. | |
| 2005/0012686 | A1 | 1/2005 | Osame et al. | |
| 2007/0052635 | A1 | 3/2007 | Kimura | |
| 2007/0085796 | A1 | 4/2007 | Osame et al. | |
| 2008/0169765 | A1 | 7/2008 | Yamazaki et al. | |
| 2009/0179549 | A1 | 7/2009 | Abe et al. | |

FOREIGN PATENT DOCUMENTS

| | | |
|---|---|---|
| JP | 2003-076315 | 3/2003 |
| JP | 2004-327431 | 11/2004 |
| JP | 2004-347625 | 12/2004 |
| JP | 2004-347626 | 12/2004 |
| JP | 2004-361424 | 12/2004 |
| JP | 2005-037415 | 2/2005 |
| WO | WO-03/027997 | 4/2003 |
| WO | WO-2004/086343 | 10/2004 |

* cited by examiner

METHOD FOR DRIVING LIGHT-EMITTING DEVICE

BACKGROUND OF THE INVENTION

1. Field of the Invention

The present invention relates to a light emitting device capable of switching an image direction vertically to horizontally and also relates to an electronic apparatus using the light emitting device.

2. Description of the Related Art

A portable electronic apparatus typified by a mobile phone, an electronic notebook and the like requires multiple functions such as sending and receiving e-mail, voice recognition, taking-in images by a small camera as well as a display device for displaying images. On the other hand, reduction in the size and weight of the portable electronic apparatus is still sought for satisfying the user needs. Therefore, as many ICs having larger circuit scale and memory capacity as possible are required to be mounted on the narrow space of the portable electronic apparatus. It is an essential part to make a flat panel display to be mounted as thin and light as possible in order to achieve the reduction in the size and weight of the portable electronic apparatus while making space for mounting ICs and realizing multiple functions.

For example, as for a liquid crystal display device which is used for a portable electronic apparatus in relatively many cases, a light source, an optical waveguide and the like are required when it is a transmissive display device, and thus reduction in the weight and thickness of the electronic apparatus is prevented. Meanwhile, in the case of a reflective liquid crystal display device utilizing outside light, an image is recognized with difficulty in the dark, resulting in abandonment of the advantage of a portable electronic apparatus that is capable of being used in all places. In view of the foregoing, a portable electronic apparatus including a light emitting device using a light emitting element as a display element has been recently developed and put into practical use. Since the light emitting element emits light by itself, an image can be clearly displayed even in the dark without a light source which is needed in the liquid crystal display device. Accordingly, the use of a back light typified by a light source and an optical waveguide can be omitted, leading to reduction in the thickness and weight of a display device.

As set forth above, the thicker and lighter a display device is, the easier it is to realize multiple functions of a portable electronic apparatus while reducing the size and weight. For example, disclosed is in Patent Document 1 below a structure of a display device which is capable of switching an image direction vertically to horizontally without a frame memory additionally provided.

Patent Document 1

Japanese Patent Laid-Open No. 2003-076315

SUMMARY OF THE INVENTION

TFTs using polycrystalline silicon have a problem that there are variations in characteristics due to a defect generated in a crystal grain boundary. In particular, when a threshold voltage of TFTs has variations, the luminance of a light emitting element to which a current is supplied in accordance with the TFTs also varies. Further, there is another problem that the luminance of a light emitting element is lowered as an electro luminescent material deteriorates. Deterioration of an electro luminescent material causes drop in luminance, even when a constant current is supplied to a light emitting element. The level of deterioration depends on the light emitting time and the amount of current. Therefore, when the level of gray scale changes per pixel in accordance with an image to be displayed, the level of deterioration of a light emitting element varies in each pixel, leading to variations in luminance.

It is to be noted that drop in luminance due to deterioration of an electro luminescent layer can be suppressed to some extent by operating in a saturation region a transistor for controlling a current value supplied to a light emitting element. In the saturation region, however, a slight variation in voltage between a gate and a source (gate voltage) Vgs affects a drain current significantly, and thus the luminance varies. Therefore, in the case of operating a transistor in a saturation region, a gate voltage Vgs of the transistor has to be kept at a constant value during a period in which a light emitting element emits light.

The gate voltage Vgs is sensitive to off-current of a transistor for controlling a video signal input to a pixel. In order to prevent the gate voltage Vgs from being varied due to the off-current, it is necessary to increase the capacitance of a capacitor provided between the gate and the source of the transistor, or to lower the off-current of the transistor for controlling a video signal input to a pixel. However, it takes time and cost to optimize the process of transistor so as to realize both the low off-current of the transistor for controlling a video signal input to a pixel and the high on-current thereof to increase the capacitance. Further, the gate voltage Vgs of the transistor for controlling a current supplied to a light emitting element is sensitive to switching of other transistors, variations in potentials of a signal line and a scan line and the like due to parasitic capacitance of the gate.

Although a light emitting device contributes to multiple functions of a portable electronic apparatus and reduction in the size and weight thereof, it has a difficulty in increasing the size of display screen. One of the reasons why the large sized display screen is required is that more information has to be displayed as a portable electronic apparatus has multiple functions. Another reason is that demand for a portable electronic apparatus for the elderly, which can display large letters on a screen, is grown as elderly population increases.

In view of the foregoing, the invention provides a light emitting device in which variations in luminance of the light emitting element due to variations in characteristics of TFTs and due to changes in a gate voltage Vgs can be suppressed while not optimizing the process of transistors, and luminance can be prevented from being lowered or varied due to deterioration of an electro luminescent material. The invention provides also a light emitting device which is capable of switching an image direction vertically to horizontally without a frame memory additionally provided. The invention further provides an electronic apparatus using such a light emitting device.

In addition to the aforementioned objects, it is still another object of the invention to provide an electronic apparatus, more specifically a portable electronic apparatus, in which a large sized display screen is achieved while reducing the weight and size of the apparatus.

According to the invention, a transistor (current controlling transistor) serving as a switching element is connected in series with a transistor (driving transistor) for supplying a current to a light emitting element. A gate potential of the driving transistor is controlled so that the driving transistor is operated in a saturation region, and thereby supplying a current all the time at least during a period for displaying an image. Meanwhile, the current controlling transistor is operated in a linear region, and a gate potential thereof is controlled by a video signal inputted to a pixel.

By operating the current controlling transistor in a linear region, a voltage Vds (drain voltage) between the source and the drain thereof is much smaller as compared with a voltage Vel applied to the light emitting element, and a current supplied to the light emitting element is not affected by a slight variation in a voltage Vgs (gate voltage) between the gate and the source. Further, by operating the driving transistor in a saturation region, a drain current is determined only by the Vgs regardless of the drain voltage Vds. In other words, the current controlling transistor selects only whether a current is supplied to the light emitting element or not, and the current value supplied to the light emitting element is determined by the driving transistor operated in a saturation region. Accordingly, a current supplied to the light emitting element can be kept at a relatively constant value even without increasing the capacitance of a capacitor provided between the gate and the source of the current controlling transistor and lowering off-current of a transistor for controlling a video signal input to a pixel. Moreover, a current supplied to the light emitting element is not affected by parasitic capacitance of the gate of the current controlling transistor. Therefore, factors affecting variations are reduced resulting in improved image quality. Also, by operating the driving transistor in a saturation region, a drain current is kept at a relatively constant value even when the Vds is lowered without increasing Vel as the light emitting element deteriorates. Thus, it is possible to suppress the drop in luminance even when the light emitting element deteriorates. Further, it is not necessary to optimize the process in order to lower off-current of a transistor for controlling a video signal input to a pixel, and therefore, the manufacturing process of a transistor can be simplified leading to reduced cost and enhanced yield.

In addition, according to the invention, at least two transistors functioning as switching elements for controlling a video signal input to a pixel are provided in the pixel and connected in series. A gate of one transistor (a first switching transistor) is electrically connected to a first scan line, and a gate of the other transistor (a second switching transistor) is electrically connected to a second scan line which intersects with the first scan line. A plurality of pixels sharing a signal line have a second scan line in common. Meanwhile, a plurality of pixels sharing a first scan line have different signal lines from each other.

The two switching elements are switched separately by the two scan lines which intersect with each other. According to this, a video signal inputted to each pixel can be switched so that an image direction is switched from a first direction to a second direction which intersect with each other. It is to be noted that more typically, the first direction and the second direction may intersect perpendicular to each other such as a vertical direction and a horizontal direction. By adopting the aforementioned structure, a light emitting device can have a function for switching the image direction vertically to horizontally without a frame memory additionally provided. Further, more multiple functions of an electronic apparatus including the light emitting device can be achieved while reducing the size and weight thereof.

Note that, the light emitting device includes both a panel in which a light emitting element is sealed and a module in which IC and the like including a controller are mounted on the panel.

It is desirable that the channel length L of the driving transistor is desirably set longer than the channel width W thereof, and the channel length L of the current controlling transistor is set equal to or shorter than the channel width W thereof. More preferably, the ratio of the channel length L to the channel width W of the driving transistor is five or more. According to such a structure, it is possible to further suppress variations in luminance of a light emitting element between pixels, which are caused by variations in characteristics of driving transistors.

It is to be noted that a transistor used in the light emitting device of the invention may be a transistor using a single crystalline silicon, a transistor using an SOI, or a thin film transistor using a polycrystalline silicon or an amorphous silicon. Alternatively, a transistor using an organic semiconductor or a transistor using a carbon nanotube may be used as well. Further, a transistor used in a pixel of the light emitting device of the invention may have a single gate structure, a double gate structure, or a multi-gate structure comprising three or more gate electrodes.

According to the invention, light may be emitted from each side of the light emitting device, and an area for displaying images may be doubled by attaching the sides back to back. In the case of displaying different images on each side, a video signal corresponding to each display area is inputted alternately. By using such a dual emission display device, an area for displaying images can be enlarged while reducing the size and weight of the light emitting device.

By adopting the aforementioned structure, variations in luminance of a light emitting element due to variations in characteristics of TFTs and due to changes of a gate voltage Vgs can be reduced while not optimizing the process of transistors, and drop in luminance and luminance unevenness of the light emitting element due to deterioration of an electro luminescent material can also be reduced. Moreover, a function of switching an image direction vertically to horizontally can be added to the light emitting device without a frame memory additionally provided, and thus, multiple functions of an electronic apparatus using the light emitting device can be achieved while reducing the size and weight thereof.

DETAILED DESCRIPTION OF THE INVENTION

Embodiment Mode 1

First, a configuration of a pixel included in the light emitting device of the invention will be described with reference to FIG. 1.

Figure 1:
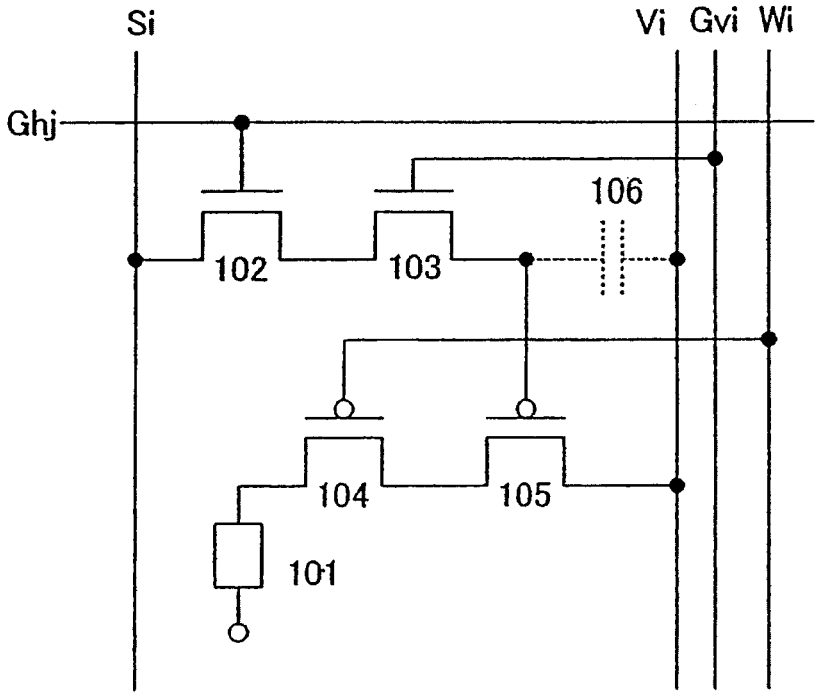
FIG. 1 is a circuit diagram showing an example of a pixel included in a light emitting device of the invention.

FIG. 1 shows an example of a pixel included in the light emitting device of the invention. The pixel shown in FIG. 1 comprises a light emitting element 101, two transistors (a first switching transistor 102 and a second switching transistor 103) used as switching elements for controlling a video signal input to the pixel, a driving transistor 104 for controlling a current value supplied to the light emitting element 101, and a current controlling transistor 105 for selecting whether a current is supplied to the light emitting element 101 or not. The pixel may also comprise a capacitor 106 for holding a video signal potential as shown in this embodiment mode.

The first switching transistor 102 and the second switching transistor 103 may have either the same conductivity or different conductivities. Although both the two switching transistors 102 and 103 have an n-type conductivity in FIG. 1, either or both of them may have a p-type conductivity. The driving transistor 104 and the current controlling transistor 105 have the same conductivity. These transistors 104 and 105 have a p-type conductivity in FIG. 1, however, they may have an n-type conductivity as well.

According to the invention, the driving transistor 104 is operated in a saturation region whereas the current controlling transistor 105 is operated in a linear region. The channel length L of the driving transistor 104 is preferably longer than the channel width W thereof, and the channel length L of the current controlling transistor 105 is preferably equal to or shorter than the channel width W thereof. More preferably, the ratio of the length L to the width W of the driving transistor 104 is five or more. In such a manner, variations in luminance of the light emitting element 101 between pixels due to variations in characteristics of the driving transistor 104 can be suppressed.

A gate of the first switching transistor 102 is connected to a first scan line Ghj (j=1 to y). On the other hand, a gate of the second switching transistor 103 is connected to a second scan line Gvi (i=1 to x). The first switching transistor 102 and the second switching transistor 103 are connected in series so as to control the connection between a signal line Si (i=1 to x) and a gate of the current controlling transistor 105. Specifically in FIG. 1, either a source or a drain of the first switching transistor 102 is connected to the signal line Si (i=1 to x), and either a source or a drain of the second switching transistor 103 is connected to the gate of the current controlling transistor 105.

Note that, the way of connecting the first switching transistor 102 and the second switching transistor 103 is not limited to that shown above. These switching transistors 102 and 103 need only to be connected in series so as to control the connection between the signal line Si (i=1 to x) and the gate of the current control transistor 105. Accordingly, for example, the arrangement of the first switching transistor 102 and the second switching transistor 103 may be exchanged.

The driving transistor 104 and the current controlling transistor 105 are connected to a first power supply line Vi (i=1 to x) and the light emitting element 101 so that a current from the first power supply line Vi (i=1 to x) is supplied to the light emitting element 101 as a drain current of the driving transistor 104 and the current controlling transistor 105. In this embodiment mode, a source of the current controlling transistor 105 is connected to the first power supply line Vi and a drain of the driving transistor 104 is connected to a pixel electrode of the light emitting element 101.

It is to be noted that a source of the driving transistor 104 may be connected to the first power supply line Vi (i=1 to x) and a drain of the current controlling transistor 105 may be connected to the pixel electrode of the light emitting element 101.

A gate of the driving transistor 104 is connected to a second power supply line Wi (i=1 to x) in FIG. 1. In the case where the gate of the driving transistor 104 is not connected to the first power supply line Vi (i=1 to x) but connected to the second power supply line Wi (i=1 to x) as shown in this embodiment mode, either an enhancement mode transistor or a depletion mode transistor may be used for the driving transistor 104. In particular, the depletion mode transistor allows an operation point to be set in a region of a saturation region, in which linearity of on-current relative to a gate voltage Vgs is higher. Therefore, as compared with the enhancement mode transistor, the depletion mode transistor is more suitable for suppressing variations in on-current when a threshold voltage, a subthreshold coefficient, mobility and the like are varied. A potential of the second power supply line Wi (i=1 to x) is set so that the driving transistor 104 is turned ON all the time.

The light emitting element 101 comprises an anode, a cathode, and an electro luminescent layer interposed between the anode and the cathode. When the driving transistor 104 is connected to the anode, the anode is referred to as a pixel electrode and the cathode is a counter electrode. The counter electrode of the light emitting element 101 and the first power supply line Vi (i=1 to x) have a potential difference so that a forward bias current is supplied to the light emitting element 101.

One of the two electrodes of the capacitor 106 is connected to the first power supply line Vi (i=1 to x), and the other is connected to the gate of the current controlling transistor 105. The capacitor 106 holds a potential difference between the electrodes of the capacitor 106 when the first switching transistor 102 or the second switching transistor 103 is not selected (in the OFF state). It is to be noted that although the capacitor 106 is provided in FIG. 1, the invention is not limited to this structure and the capacitor 106 is not necessarily provided.

In FIG. 1, a p-channel transistor is used for both the driving transistor 104 and the current controlling transistor 105, and the drain of the driving transistor 104 is connected to the anode of the light emitting element 101. Meanwhile, when an n-channel transistor is used for both the driving transistor 104 and the current controlling transistor 105, the source of the driving transistor 104 is connected to the cathode of the light emitting element 101. In the latter case, the cathode of the light emitting element 101 serves as a pixel electrode whereas the anode thereof serves as a counter electrode.

Note that, the gate of the driving transistor 104 is connected to the second power supply line Wi in FIG. 1, however, the invention is not limited to this. The gate of the driving transistor 104 may be connected to the first power supply line Vi or the gate of the current controlling transistor 105 instead of the second power supply line Wi.

Next, a driving method of the pixel shown in FIG. 1 is described. The operation of the pixel shown in FIG. 1 is divided into a writing period and a holding period.

When the first scan line Ghj (j=1 to y) and the second scan line Gvi (i=1 to x) are selected in a writing period, the first switching transistor 102 having the gate connected to the first scan line Ghj (j=1 to y) and the second switching transistor 103 having the gate connected to the second scan line Gvi (i=1 to x) are both turned ON. Then, a video signal inputted to the signal line Si (i=1 to x) is sequentially inputted to the gate of the current controlling transistor 105 via the first switching transistor 102 and the second switching transistor 103. Note that, the gate of the driving transistor 104 is connected to the second power supply line Wi, and thus the driving transistor 104 is in the ON state all the time.

In the case where the current controlling transistor 105 is turned ON by a video signal, a current is supplied to the light emitting element 101 via the first power supply line Vi. Since the current controlling transistor 105 is operated in a linear region at this time, a current value supplied to the light emitting element 101 is determined by voltage-current characteristics of the driving transistor 104 operating in a saturation region and the light emitting element 101. Then, the light emitting element 101 emits light at a luminance level corresponding to the supplied current value. In the case where the current controlling transistor 105 is turned OFF by a video signal, no current is supplied to the light emitting element 101 and thus the light emitting element 101 emits no light.

In a holding period, a potential of the first scan line Ghj (j=1 to y) or the second scan line Gvi (i=1 to x) is controlled to turn OFF either or both of the first switching transistor 102 and the second switching transistor 103, thereby holding a video signal potential which has been written in the writing period. In the case of turning the current controlling transistor 105 ON in the writing period, a current supply to the light emitting element 101 is continued since the video signal potential is held by the capacitor 106. On the other hand, in the case of turning the current controlling transistor 105 OFF in the writing period, no current is supplied to the light emitting element 101 since the video signal potential is held by the capacitor 106.

The current controlling transistor 105 is operated in a linear region. Therefore, a voltage Vds (drain voltage) between the source and the drain of the current controlling transistor 105 is quite small relative to a voltage Vel applied to the light emitting element 101, and a slight variation in a voltage Vgs (gate voltage) between the gate and the source does not affect a current supplied to the light emitting element 101. The driving transistor 104 is operated in a saturation region. Accordingly, the drain current of the driving transistor 104 is not varied by the drain voltage Vds thereof and thus determined only by the voltage Vgs thereof in a saturation region. That is, the current controlling transistor 105 selects only whether a current is supplied to the light emitting element 101 or not, and a current value supplied to the light emitting element 101 is determined by the driving transistor 104 operated in a saturation region. Thus, variations in current supplied to the light emitting element 101 can be suppressed without increasing the capacitance of the capacitor 106 provided between the gate and the source of the current controlling transistor 105 or reducing off-current of the first switching transistor 102. Further, by operating the driving transistor 104 in a saturation region, the amount of the drain current of the driving transistor 104 can be kept at relatively constant even when the Vds of the driving transistor 104 is lowered according to the Vel increasing as deterioration of the light emitting element 101. According to this, drop in luminance can be suppressed even when the light emitting element 101 deteriorates.

Note that, when controlling operations of a first scan line driver circuit and a second scan line driver circuit from the beginning of a writing period in one pixel until the end of writing periods in all the pixels, a video signal inputted to each pixel can be switched leading to switching of an image direction from a first direction to a second direction which intersect with each other. Scan directions of each scan line before and after the switching of an image direction will be described hereinafter.

Figure 2A:
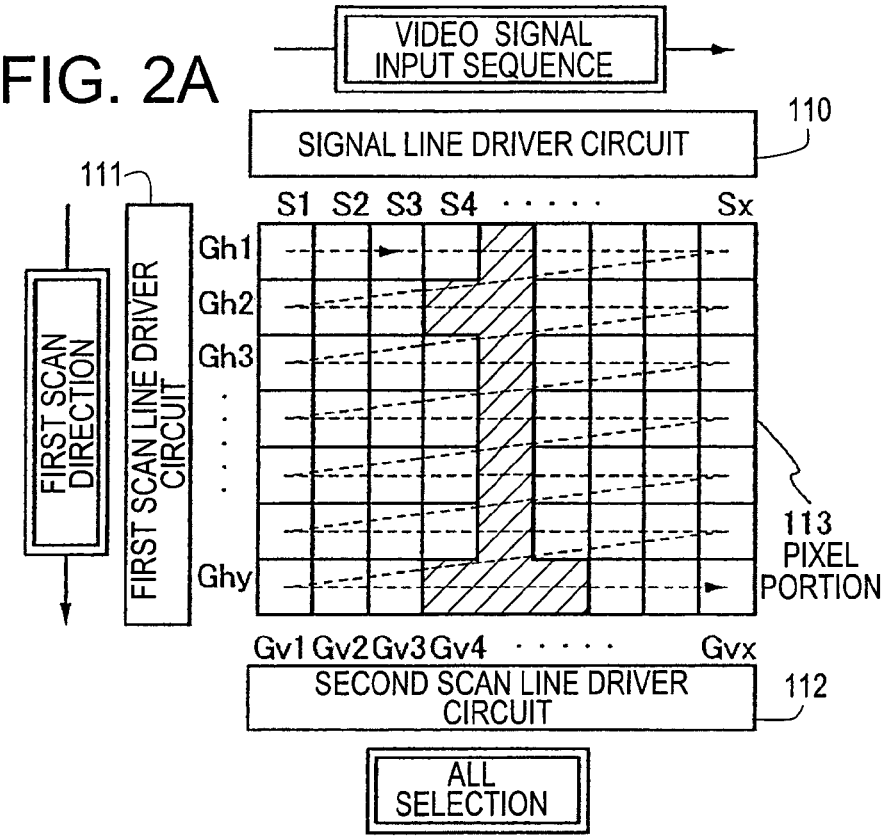
FIGS. 2A and 2B are block diagrams of a light emitting device, which show a scan direction and an input sequence of video signal.

With reference to FIG. 2A, explanation is made on a scan direction of the first scan lines Gh1 to Ghy in the case of selecting the second scan lines Gv1 to Gvx all at once and selecting the first scan lines Gh1 to Ghy in sequence. Reference numeral 113 denotes a pixel portion included in the light emitting device of the invention, 110 denotes a signal line driver circuit for controlling a video signal input to the signal line Si, 111 denotes a first scan line driver circuit for selecting the first scan line Ghj, and 112 denotes a second scan line driver circuit for selecting the second scan line Gvi.

It is assumed that the pixel portion 113 comprises xy pixels. Each first scan line Ghj (j=1 to y) is shared by x pixels, and each second scan line Gvi (i=1 to x) is shared by y pixels. The y pixels sharing the second scan line Gvi (i=1 to x) have each signal line Si (i=1 to x) in common. Meanwhile, the x pixels sharing the first scan line Ghj (j=1 to y) have different signal lines from each other.

Accordingly, in the case of selecting the first scan lines Gh1 to Ghy in sequence and selecting the second scan lines Gv1 to Gvx all at once, a video signal is sequentially inputted from each signal line Si (i=1 to x) to x pixels sharing a selected first scan line. Then, a video signal is sequentially inputted from each signal line Si (i=1 to x) to x pixels sharing the next selected first scan line. That is, when a video signal is sequentially inputted from the signal lines S1 to Sx and the first scan line is sequentially selected from Gh1 to Ghy, a video signal is sequentially inputted to each pixel in the direction of an arrow with a dotted line and the first scan line Ghj (j=1 to y) is sequentially scanned in a first scan direction shown by an arrow with a continuous line.

Figure 2B:
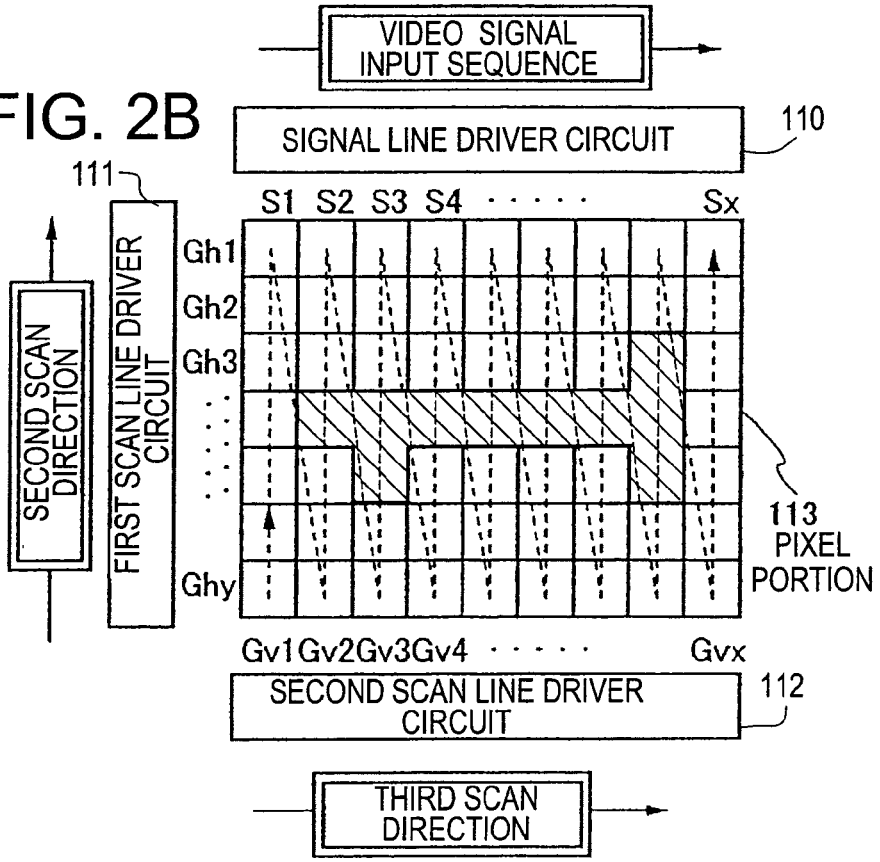

With reference to FIG. 2B, described is an operation of the light emitting device shown in FIG. 2A, in the case where the first scan lines Gh1 to Ghy are selected in the reverse order from the case shown in FIG. 2A and the second scan lines Gv1 to Gvx are selected in sequence.

In FIG. 2B, the first scan lines Gh1 to Ghy are selected in the reverse order from in FIG. 2A. Further, the second scan lines Gv1 to Gvx are selected in sequence during each period in which each of the first scan lines is selected. Thus, x pixels sharing a selected first scan line are sequentially selected by the second scan lines to input a video signal from the corresponding signal line to the selected pixel. Similarly, x pixels sharing the next selected first scan line are sequentially selected by the second scan lines to input a video signal from the corresponding signal line to the selected pixel.

That is, a video signal is sequentially inputted from the signal line S1 to Sx, the first scan line is sequentially selected from Ghy to Gh1 in a second scan direction shown by an arrow with a continuous line, and the second scan line is sequentially selected from Gv1 to Gvx in a third scan direction shown by an arrow with a continuous line. At this time, a video signal is inputted to each pixel in the direction of an arrow with a dotted line.

The second scan direction is opposite to the first scan direction. The third scan direction is set so that an input sequence of a video signal to the signal line is the same both in FIG. 2A and FIG. 2B.

In such a manner, a video signal inputted to each pixel can be switched between FIG. 2A and FIG. 2B, thereby changing an image direction. When assumed that the vertical direction of an image in FIG. 2A is a first direction and that of an image in FIG. 2B is a second direction, the first direction and the second direction intersect with each other.

Specifically, when x is equal to y, a video signal inputted to a pixel (j, i) having the first scan line Ghj and the second scan line Gvi is inputted to a pixel (i, j) having the first scan line Ghi and the second scan line Gvj. It is to be noted that when x is not equal to y, xy' (y'=x−y) pixels are prepared in the case of x>y, whereas x'y (x'=y−x) pixels are prepared in the case of y>x. In the actual display, only xy pixels of the aforementioned pixels are used selectively, and the pixels which are not used for displaying images are used when switching an image direction. More specifically, the timing of a start pulse signal inputted to the signal line driver circuit, the first scan line driver circuit, and the second scan line driver circuit may be changed, or a dummy video signal may be inputted to a pixel which is not used.

It is to be noted that in the operation shown in FIG. 2B, the scan speed of the second scan line driver circuit 112 is slower than that of the first scan line driver circuit 111. Further in FIG. 2B, the signal line driver circuit 110 inputs a video signal to a pixel in synchronism with the scanning of the first scan line driver circuit 111.

As set forth above, according to the invention, an image direction can be switched between the first direction and the second direction which intersect with each other.

Embodiment Mode 2

Explained in this embodiment mode is a structure of the light emitting device of the invention in which light is emitted from each side of a light emitting element.

In the case of a dual emission display device, an image is inverted to be displayed on each screen. Therefore, when switching a display screen, it is necessary to change an input sequence of a video signal from a signal line driver circuit to a signal line and a scan direction of a second scan line driver circuit as well as to change an image direction vertically to horizontally.

Figure 3A:
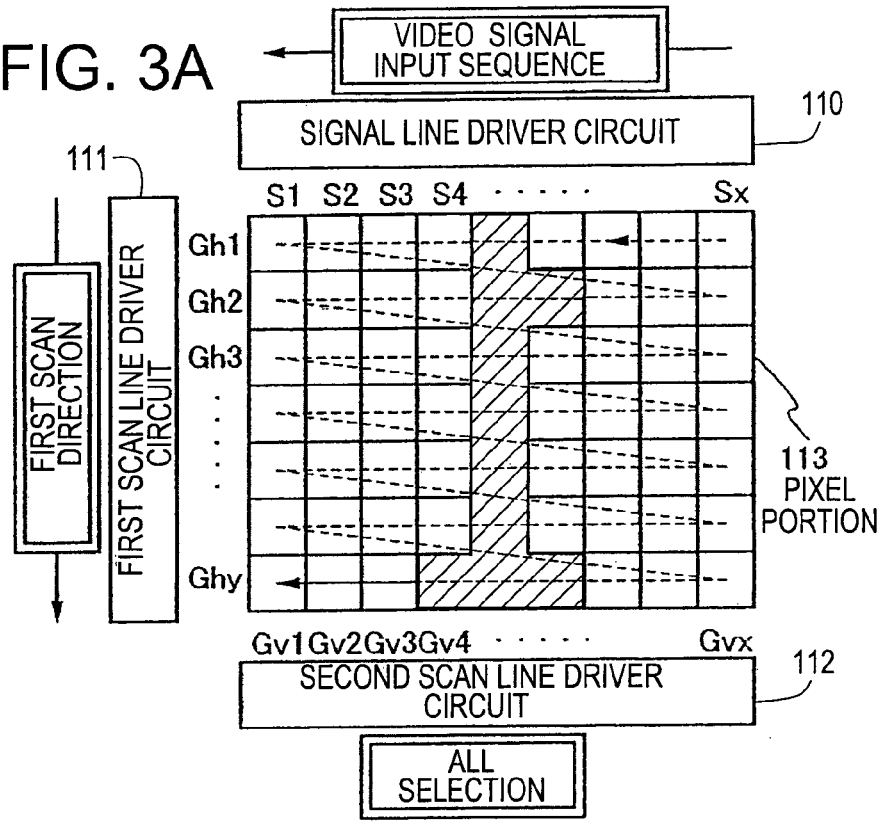
FIGS. 3A and 3B are block diagrams of a light emitting device, which show a scan direction and an input sequence of video signal.

First, an operation for inverting the image shown in FIG. 2A left to right is explained with reference to FIG. 3A. In this case, the second scan lines Gv1 to Gvx are selected all at once as in FIG. 2A and the first scan lines Gh1 to Ghy are scanned in the same sequence as in FIG. 2A. In FIG. 3A, however, a video signal input from the signal line driver circuit 110 to the signal lines S1 to Sx is performed in the reverse order from in FIG. 2A. Thus, when a video signal is sequentially inputted from the signal line S1 to the signal line Sx in FIG. 2A, a video signal is sequentially inputted from the signal line Sx to the signal line S1 in FIG. 3A. According to the aforementioned structure, a video signal is sequentially inputted to each pixel in the direction of an arrow with a dotted line. Therefore, an image is inverted left to right, and thus, the image can be displayed in the original direction when seen from the other side.

Next, an operation for inverting the image shown in FIG. 2B left to right is described with reference to FIG. 3B. In this case, the first scan lines Gh1 to Ghy are scanned in the same sequence as in FIG. 2B. Further in FIG. 3B, the second scan lines Gv1 to Gvx are scanned in the reverse order from in FIG. 2B, and a video signal input from the signal line driver circuit 110 to the signal lines S1 to Sx is performed in the reverse order from in FIG. 2B. Accordingly, when the second scan line is sequentially scanned from Gv1 to Gvx in the third scan direction and a video signal is sequentially inputted from the signal line S1 to the signal line Sx in FIG. 2B, the second scan line is sequentially scanned from Gvx to Gv1 in a fourth direction which is the reverse direction from the second scan direction, and a video signal is sequentially inputted from the signal line Sx to the signal line S1 in FIG. 3B. According to the aforementioned structure, a video signal can be inputted to each pixel in the direction of an arrow with a dotted line. Therefore, an image is inverted left to right and upside down, and the image can be displayed with vertically or horizontally switched to the original direction when seen from the other side.

Figure 3B:
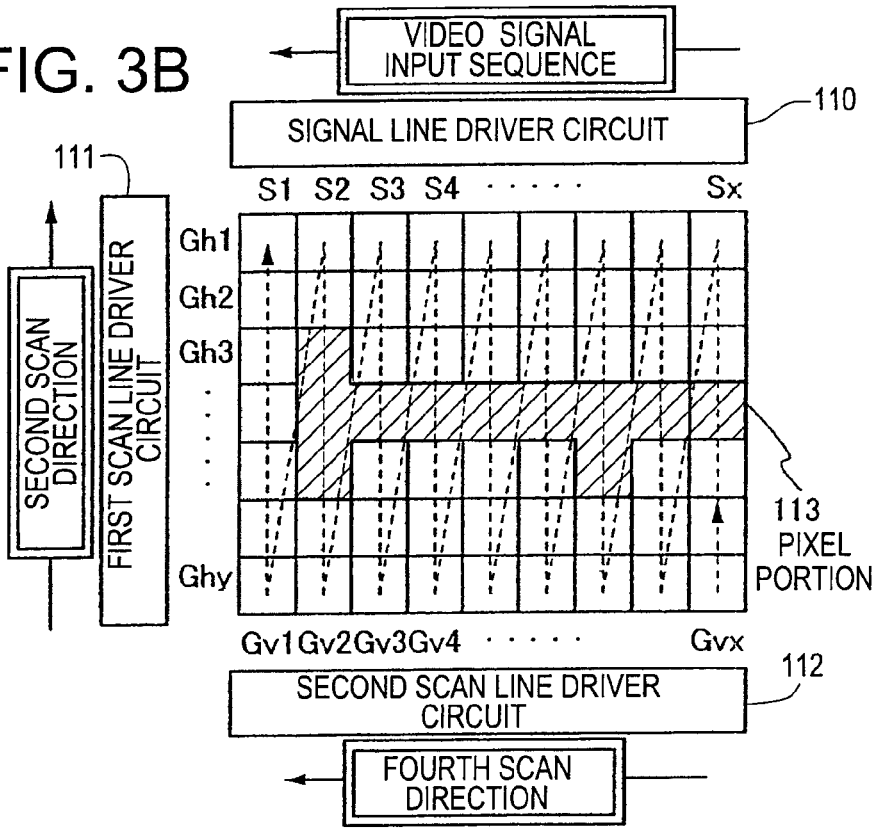

It is to be noted that in the operation shown in FIG. 3B, the scan speed of the second scan line driver circuit 112 is slower than that of the first scan line driver circuit 111. Further in FIG. 3B, the signal line driver circuit 110 inputs a video signal to a pixel in synchronism with the scanning of the first scan line driver circuit 111.

In order to reduce the operating frequency of the signal line driver circuit, a division driving method may be used. In the division driving method, pixels arranged in the first scan direction or the second scan direction are divided into groups of m pixels (m is a positive number of two or more, and a natural number in general), and video signals are simultaneously inputted to pixels in the same group during one scan period and sequentially inputted for every group. Since m pixels in the same group are selected at the same time in this driving method, an image direction is not inverted even when switching the scan direction. In order to change an image direction in the division driving method, video signals themselves have to be switched by using a frame memory so that the video signals inputted to the pixels in the same group are inverted. However, a frame memory required for changing an image direction vertically to horizontally in the division driving method is used for only changing the video signals corresponding to the m pixels. Thus, storage capacitor of the frame memory in the division driving method is much smaller as compared with that used for inverting all the video signals to change an image direction vertically to horizontally while not changing the order of selecting a pixel. In the division driving method in which pixels are divided into groups of m pixels, the time for inputting video signals to each pixel is m times longer than that in the normal driving method when the length of one scan period is the same. Therefore, the operating frequency of the signal line driver circuit can be made one m-th smaller than that in the normal driving method.

Figure 4A:
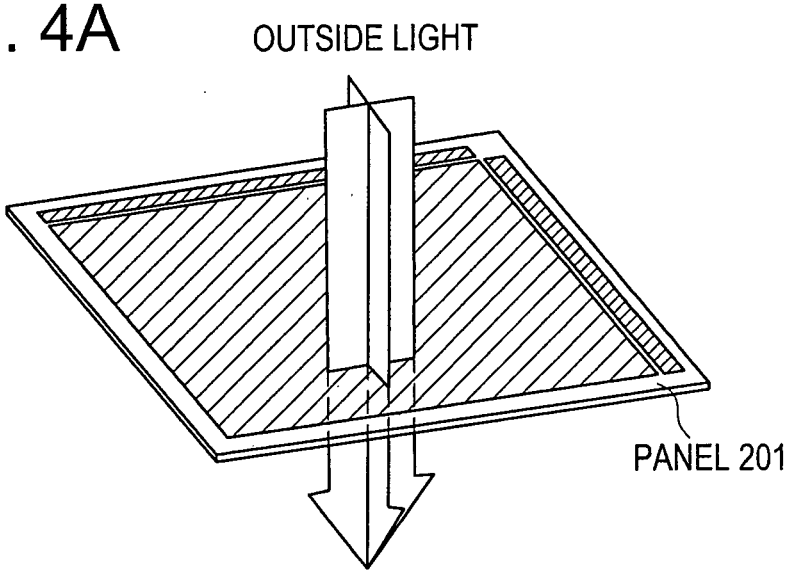
FIGS. 4A and 4B are views showing a structure of the light emitting device of the invention using a polarizer.
Figure 4B:
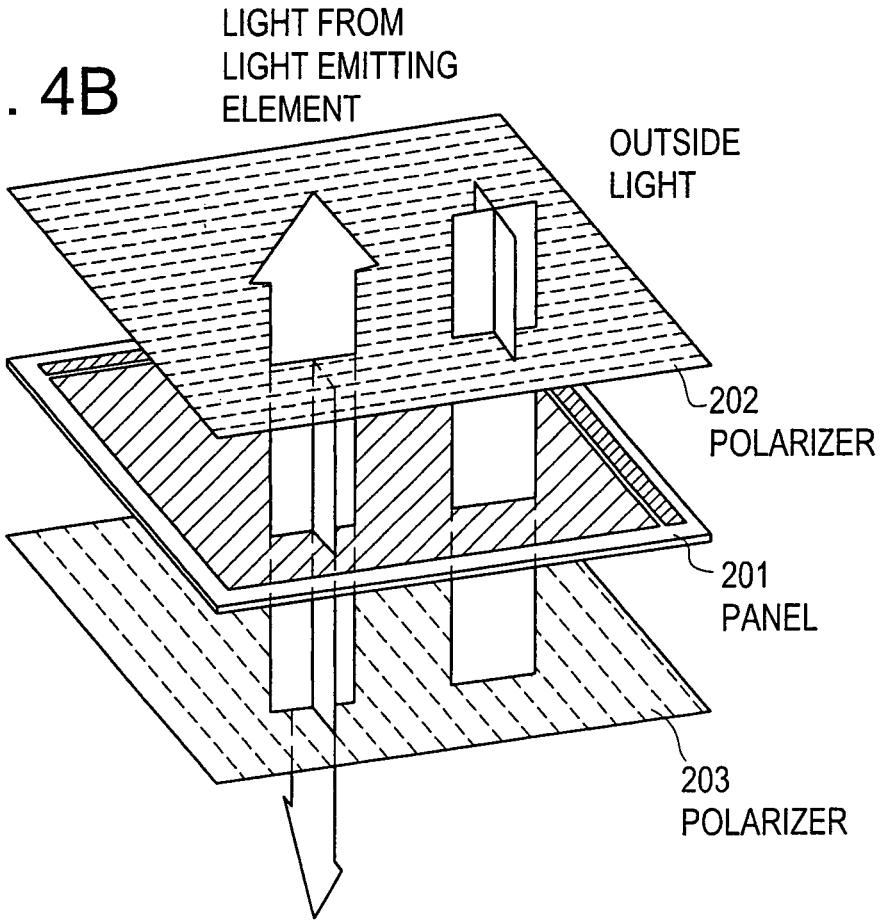

A light emitting element included in the dual emission display device has light transmissive anode and cathode. Accordingly, outside light is transmitted to a panel 201 of the light emitting device as shown in FIG. 4A, and thus the far side of the panel 201 is seen by human eyes. On the other hand, when polarizers 202 and 203 are disposed so that the polarization directions differ from each other, more preferably the polarization directions are 90° between them as shown in FIG. 4B, outside light is transmitted to either the polarizer 202 or 203. It is thus possible to prevent the far side from being seen and to enhance the contrast of an image. Further, a specific polarization component is transmitted to each of the polarizers 202 and 203, therefore, light from the panel 201 can be emitted to each side.

It is to be noted that in order to enhance the contrast of an image, liquid crystal panels using liquid crystal elements may be disposed on both sides instead of the polarizers so as to transmit light emitted from the light emitting element to only one side.

The light emitting device of the invention can display color images as well as monochrome images. Any method can be adopted for displaying color images. For example, a white light emitting element may be used in combination with a color filter, light emitting elements corresponding to RGB may be used for full color display, or CCM method and the like may be adopted.

As described in this embodiment mode, image display on both sides contributes to enlarged screen for displaying images and reduced size and weight of the light emitting device. The invention is thus useful, especially for a portable electronic apparatus which is required to reduce the size and weight.

Embodiment Mode 3

Described in this embodiment mode is a configuration of the pixel shown in FIG. 1, which is added with a function for stopping light emission of a light emitting element independently on a video signal.

Figure 5:
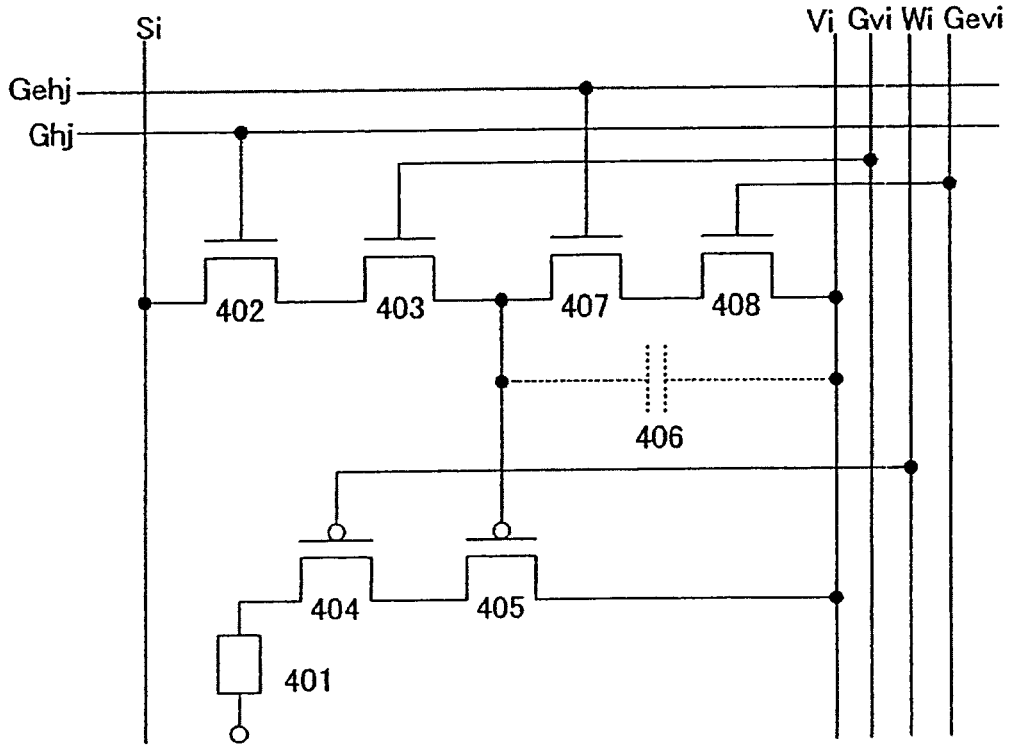
FIG. 5 is a circuit diagram showing an example of a pixel included in the light emitting device of the invention.

FIG. 5 shows an example of a pixel included in the light emitting device of the invention. The pixel shown in FIG. 5 comprises a light emitting element 401, two switching transistors 402 and 403 used as switching elements controlling a video signal input to the pixel, a driving transistor 404 for controlling a current value supplied to the light emitting element 401, a current controlling transistor 405 for selecting whether a current is supplied to the light emitting element 401 or not, and two erasing transistors 407 and 408 for stopping light emission of the light emitting element 401. The pixel may also comprise a capacitor 406 for holding a video signal potential as shown in this embodiment mode.

As in the pixel shown in FIG. 1, the first switching transistor 402 and the second switching transistor 403 may have either the same conductivity or different conductivities. The driving transistor 404 and the current controlling transistor 405 have the same conductivity as in the pixel shown in FIG. 1. Further, the driving transistor 404 is operated in a saturation region and the current controlling transistor 405 is operated in a linear region in FIG. 5 as well as in FIG. 1. The first erasing transistor 407 and the second erasing transistor 408 may have either the same conductivity or different conductivities. It is desirable that the channel length L of the driving transistor 404 is longer than the channel width W thereof and the channel length L of the current controlling transistor 405 is equal to or shorter than the channel width W thereof. More preferably, the ratio of the channel length L to the width W of the driving transistor 404 is five or more. According to such a structure, variations in luminance of the light emitting element in each pixel due to variations in characteristics of the driving transistor can be suppressed.

The pixel shown in FIG. 5 is different from the one shown in FIG. 1 in that the two erasing transistors 407 and 408 are connected in series between the current controlling transistor 405 and a power supply line Vi. A gate of the first erasing transistor 407 is connected to a first erasing scan line Gehj (j=1 to y), and a gate of the second erasing transistor 408 is connected to a second erasing scan line Gevi (i=1 to x). When the first and the second erasing transistors 407 and 408 are both turned ON, a gate and a source of the current controlling transistor 405 are connected and the current controlling transistor 405 is turned OFF, thereby stopping light emission of the light emitting element 401 independently on a video signal.

Embodiment Mode 4

Described in this embodiment mode is a configuration of a pixel included in the light emitting device of the invention, which differs from those shown in FIGS. 1 and 5.

Figure 6A:
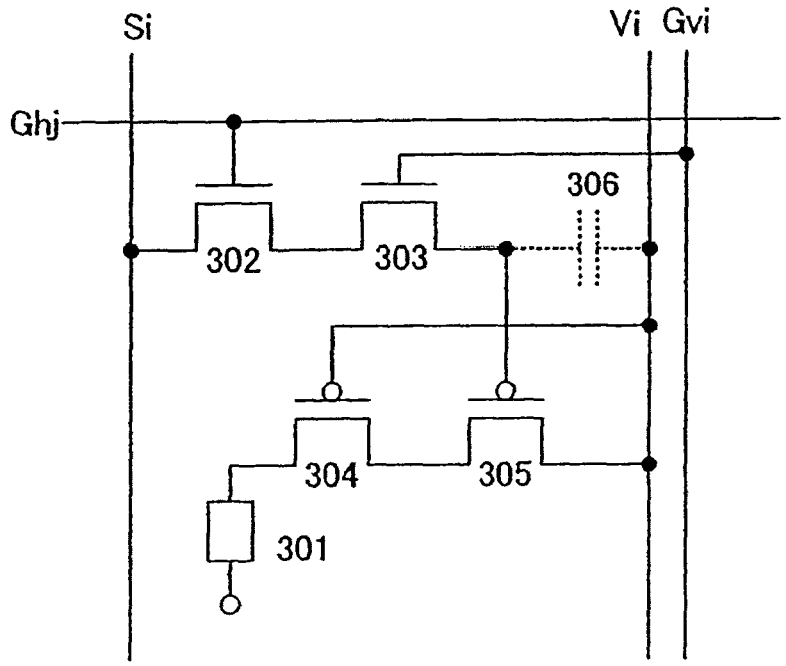
FIGS. 6A and 6B are circuit diagrams showing an example of a pixel included in the light emitting device of the invention.

FIG. 6A shows an example of a pixel included in the light emitting device of the invention. The pixel shown in FIG. 6A comprises a light emitting element 301, two switching transistors 302 and 303 used as switching elements for controlling a video signal input to the pixel, a driving transistor 304 for controlling a current value supplied to the light emitting element 301, and a current controlling transistor 305 for selecting whether a current is supplied to the light emitting element 301 or not. The pixel may also comprise a capacitor 306 for holding a video signal potential as shown in this embodiment mode.

As in the pixel shown in FIG. 1, the first switching transistor 302 and the second switching transistor 303 may have either the same conductivity or different conductivities. The driving transistor 304 and the current controlling transistor 305 have the same conductivity as in the pixel shown in FIG. 1. Further, the driving transistor 304 is operated in a saturation region and the current controlling transistor 305 is operated in a linear region in FIG. 6A as well as in FIG. 1. It is desirable that the channel length L of the driving transistor 304 is longer than the channel width W thereof and the channel length L of the current controlling transistor 305 is equal to or shorter than the channel width W thereof. More preferably, the ratio of the channel length L to the width W of the driving transistor 304 is five or more. According to such a structure, variations in luminance of the light emitting element in each pixel due to variations in characteristics of the driving transistor can be suppressed.

The pixel shown in FIG. 6A is different from the one shown in FIG. 1 in that a gate of the driving transistor 304 as well as a source of the current controlling transistor 305 is connected to a power supply line Vi. Since a depletion mode transistor is used for the driving transistor 304 in the pixel shown in FIG. 6A, an operation point can be set in a region of a saturation region, in which linearity of on-current relative to a gate voltage Vgs is higher. Accordingly, as compared with an enhancement mode transistor, the depletion mode driving transistor 304 is suitable for suppressing variations in on-current when a threshold voltage, a subthreshold coefficient, mobility and the like are varied. For the transistors other than the driving transistor 304, either an normal enhancement mode transistor or a depletion mode transistor may be used.

Explanation is hereinafter made on a configuration of the pixel shown in FIG. 6A, which is added with a function for stopping light emission of a light emitting element independently on a video signal.

Figure 6B:
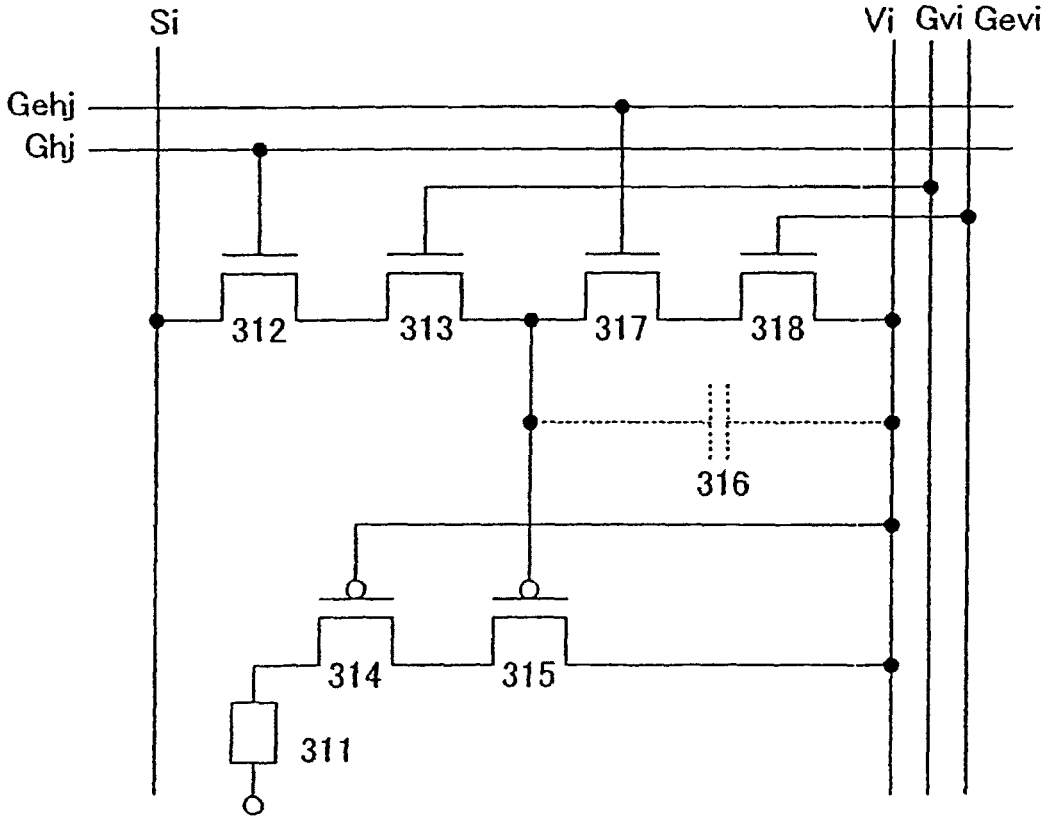

FIG. 6B shows an example of a pixel included in the light emitting device of the invention. The pixel shown in FIG. 6B comprises a light emitting element 311, two switching transistors 312 and 313 used as switching elements for controlling a video signal input to the pixel, a driving transistor 314 for controlling a current value supplied to the light emitting element 311, a current controlling transistor 315 for selecting whether a current is supplied to the light emitting element 311 or not, and two erasing transistors 317 and 318 for stopping light emission of the light emitting element 311. The pixel may also comprise a capacitor 316 for holding a video signal potential as shown in this embodiment mode.

As in the pixel shown in FIG. 6A, the first switching transistor 312 and the second switching transistor 313 may have either the same conductivity or different conductivities. The driving transistor 314 and the current controlling transistor 315 have the same conductivity as in the pixel shown in FIG. 6A. Further, the driving transistor 314 is operated in a saturation region and the current controlling transistor 315 is operated in a linear region in FIG. 6B as well as in FIG. 6A. The first erasing transistor 317 and the second erasing transistor 318 may have either the same conductivity or different conductivities. It is desirable that the channel length L of the driving transistor 314 is longer than the channel width W thereof and the channel length L of the current controlling transistor 315 is equal to or shorter than the channel width W thereof. More preferably, the ratio of the channel length L to the width W of the driving transistor 314 is five or more. According to such a structure, variations in luminance of the light emitting element in each pixel due to variations in characteristics of the driving transistor can be suppressed.

The pixel shown in FIG. 6B is different from the one shown in FIG. 6A in that the two erasing transistors 317 and 318 are connected in series between the current controlling transistor 315 and a power supply line Vi. A gate of the first erasing transistor 317 is connected to a first erasing scan line Gehj (j=1 to y), and a gate of the second erasing transistor 318 is connected to a second erasing scan line Gevi (i=1 to x). When the first and the second erasing transistors 317 and 318 are both turned ON, a gate and a source the current controlling transistor 315 are connected and the current controlling transistor 315 is turned OFF, thereby stopping light emission of the light emitting element 311 independently on a video signal.

Embodiment Mode 5

Described in this embodiment mode is a configuration of a pixel included in the light emitting device of the invention, which differs from those shown in FIGS. 1, 5, and 6A and 6B.

Figure 7A:
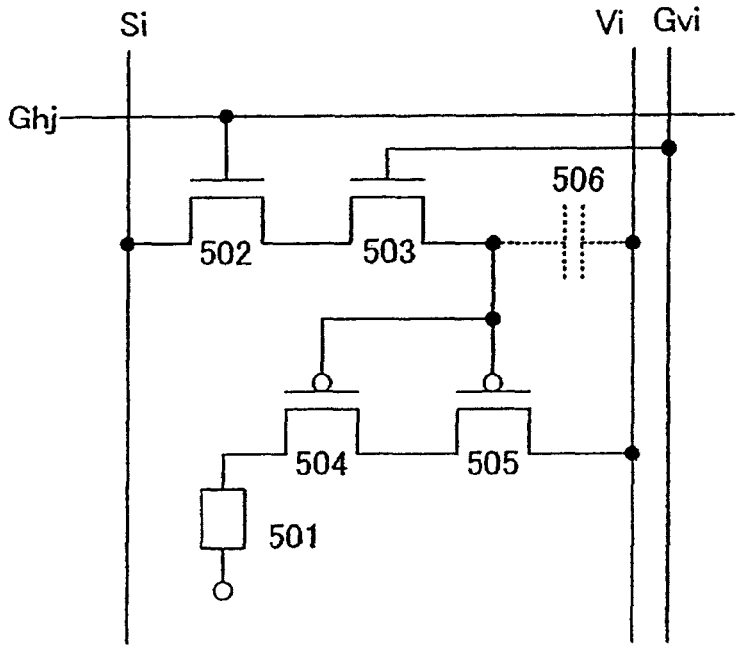
FIGS. 7A and 7B are circuit diagrams showing an example of a pixel included in the light emitting device of the invention.

FIG. 7A shows an example of a pixel included in the light emitting device of the invention. The pixel shown in FIG. 7A comprises a light emitting element 501, two switching transistors 502 and 503 used as switching elements for controlling a video signal input to the pixel, a driving transistor 504 for controlling a current value supplied to the light emitting element 501, and a current controlling transistor 505 for selecting whether a current is supplied to the light emitting element 501 or not. The pixel may also comprise a capacitor 506 for holding a video signal potential as shown in this embodiment mode.

As in the pixel shown in FIG. 1, the first switching transistor 502 and the second switching transistor 503 may have either the same conductivity or different conductivities. The driving transistor 504 and the current controlling transistor 505 have the same conductivity as in the pixel shown in FIG. 1. In FIG. 7A, the ratio L/W of the driving transistor 504 is made larger than the ratio L/W of the current controlling transistor 505, and the driving transistor 504 is operated in a saturation region whereas the current controlling transistor 505 is operated in a linear region. Specifically in the driving transistor 504, the channel length L is set longer than the channel width W thereof, and more preferably set five or more times longer. Further, the channel length L of the current controlling transistor 505 is set equal to or shorter than the channel width W thereof.

The pixel shown in FIG. 7A is different from the one shown in FIG. 1 in that a gate of the driving transistor 504 is connected to a gate of the current controlling transistor 505. Either an enhancement mode transistor or a depletion mode transistor may be used for the driving transistor 504 in the pixel shown in FIG. 7A. In particular, by using the depletion mode transistor, an operation point can be set in a region of a saturation region, in which linearity of on-current relative to a gate voltage Vgs is higher. Thus, as compared with the enhancement mode transistor, the depletion mode transistor is suitable for suppressing variations in on-current when a threshold voltage, a subthreshold coefficient, mobility and the like are varied.

Explanation is hereinafter made on a configuration of the pixel shown in FIG. 7A, which is added with a function for stopping light emission of the light emitting element independently on a video signal.

Figure 7B:
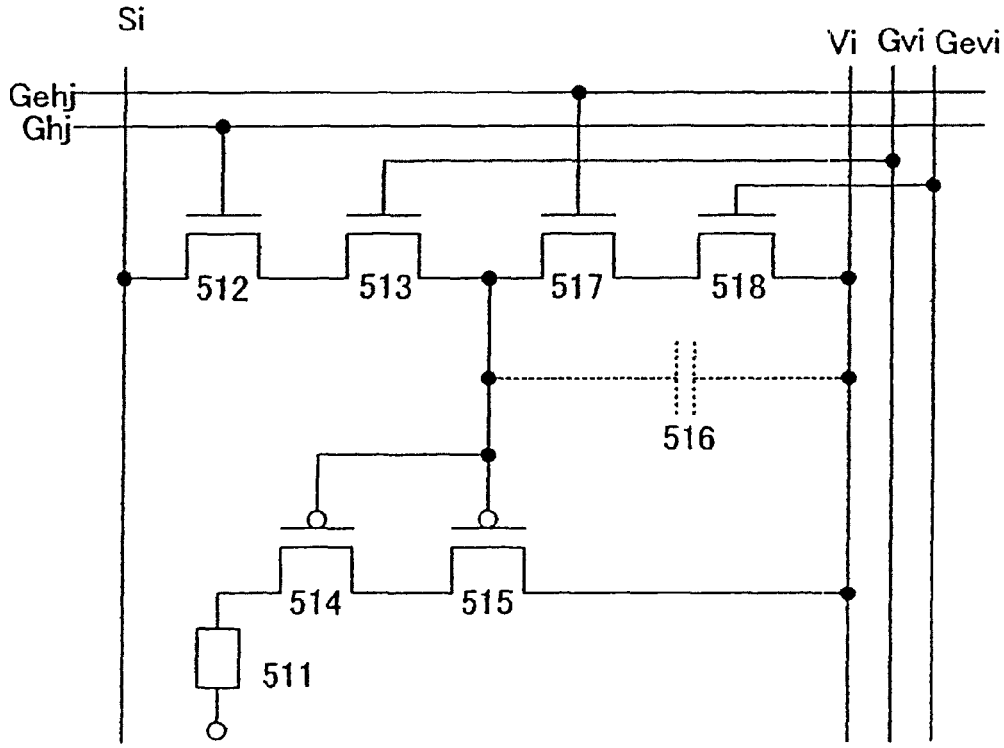

FIG. 7B shows an example of a pixel included in the light emitting device of the invention. The pixel shown in FIG. 7B comprises a light emitting element 511, two switching transistors 512 and 513 used as switching elements for controlling a video signal input to the pixel, a driving transistor 514 for controlling a current value supplied to the light emitting element 511, a current controlling transistor 515 for selecting whether a current is supplied to the light emitting element 511 or not, and two erasing transistors 517 and 518 for stopping light emission of the light emitting element 511. The pixel may also comprise a capacitor 516 for holding a video signal potential as shown in this embodiment mode.

As in the pixel shown in FIG. 7A, the first switching transistor 512 and the second switching transistor 513 may have either the same conductivity or different conductivities. The driving transistor 514 and the current controlling transistor 515 have the same conductivity as in the pixel shown in FIG. 7A. Further, the driving transistor 514 is operated in a saturation region and the current controlling transistor 515 is operated in a linear region in FIG. 7B as well as in FIG. 7A. The first erasing transistor 517 and the second erasing transistor 518 may have either the same conductivity or different conductivities.

The pixel shown in FIG. 7B is different from the one shown in FIG. 7A in that the two erasing transistors 517 and 518 are connected in series between the current controlling transistor 515 and a power supply line Vi. A gate of the first erasing transistor 517 is connected to a first erasing scan line Gehj (j=1 to y), and a gate of the second erasing transistor 518 is connected to a second erasing scan line Gevi (i=1 to x). When the first and the second erasing transistors 517 and 518 are both turned ON, a gate and a source of the current controlling transistor 515 are connected and the current controlling transistor 515 is turned OFF, thereby stopping light emission of the light emitting element 511 independently on a video signal.

Embodiment Mode 6

Described in this embodiment mode is a configuration of a pixel included in the light emitting device of the invention, which differs from those shown in FIGS. 1, 5, 6A and 6B, and 7A and 7B.

Figure 8:
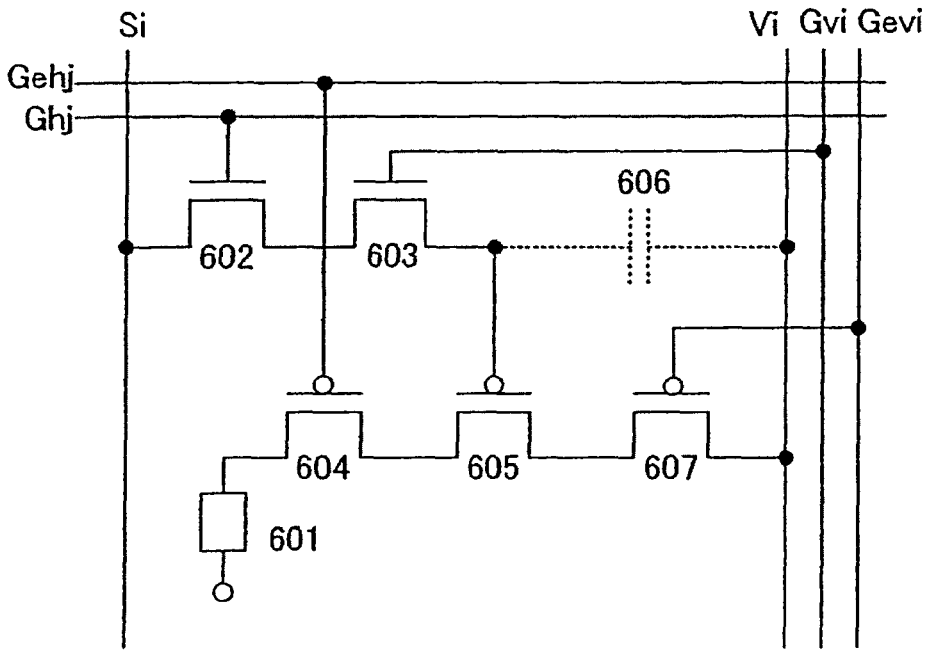
FIG. 8 is a circuit diagram showing an example of a pixel included in the light emitting device of the invention.

FIG. 8 shows an example of a pixel included in the light emitting device of the invention. The pixel shown in FIG. 8 comprises a light emitting element 601, two switching transistors 602 and 603 used as switching elements for controlling a video signal input to the pixel, a driving transistor 604 for controlling a current value supplied to the light emitting element 601, a current controlling transistor 605 for selecting whether a current is supplied to the light emitting element 601 or not, and an erasing transistor 607 for stopping light emission of the light emitting element 601. The pixel may also comprise a capacitor 606 for holding a video signal potential as shown in this embodiment mode.

As in the pixel shown in FIG. 1, the first switching transistor 602 and the second switching transistor 603 may have either the same conductivity or different conductivities in the pixel shown in FIG. 8. Further, the driving transistor 604 and the current controlling transistor 605 have the same conductivity as in FIG. 1. It is desirable that the channel length L of the driving transistor 604 is longer than the channel width W thereof and the channel length L of the current controlling transistor 605 is equal to or shorter than the channel width W thereof. More preferably, the ratio of the channel length L to the channel width W of the driving transistor 604 is five or more. According to such a structure, variations in luminance of the light emitting element in each pixel due to variations in characteristics of the driving transistor can be suppressed.

The pixel shown in FIG. 8 is different from the one shown in FIG. 1 in that a gate of the driving transistor 604 is connected to a first erasing scan line Gehj (j=1 to y) and a gate of the erasing transistor 607 is connected to a second erasing scan line Gevi (i=1 to x). The erasing transistor 607 is connected between the current controlling transistor 605 and a power supply line Vi (i=1 to x). Either an enhancement mode transistor or a depletion mode transistor may be used for the driving transistor 604 in the pixel shown in FIG. 8. In particular, by using the depletion mode transistor, an operation point can be set in a region of a saturation region, in which linearity of on-current relative to a gate voltage Vgs is higher. Therefore, as compared with the enhancement mode transistor, the depletion mode transistor is more suitable for suppressing variations in on-current when a threshold voltage, a subthreshold voltage, mobility and the like are varied. When either or both of the driving transistor 604 and the erasing transistor 607 are turned OFF, it is possible to stop light emission of the light emitting element 601 independently on a video signal.

It is to be noted that the erasing transistor 607 and the driving transistor 604 need only to be connected so as to control the supply of a drain current of the current controlling transistor 605 to the light emitting element 601. Therefore, the arrangement of the erasing transistor 607, the driving transistor 604 and the current controlling transistor 605 is not limited to the one shown in FIG. 8, and they need only to be connected in series between the light emitting element 601 and the power supply line Vi.

Embodiment 1

Figure 9:
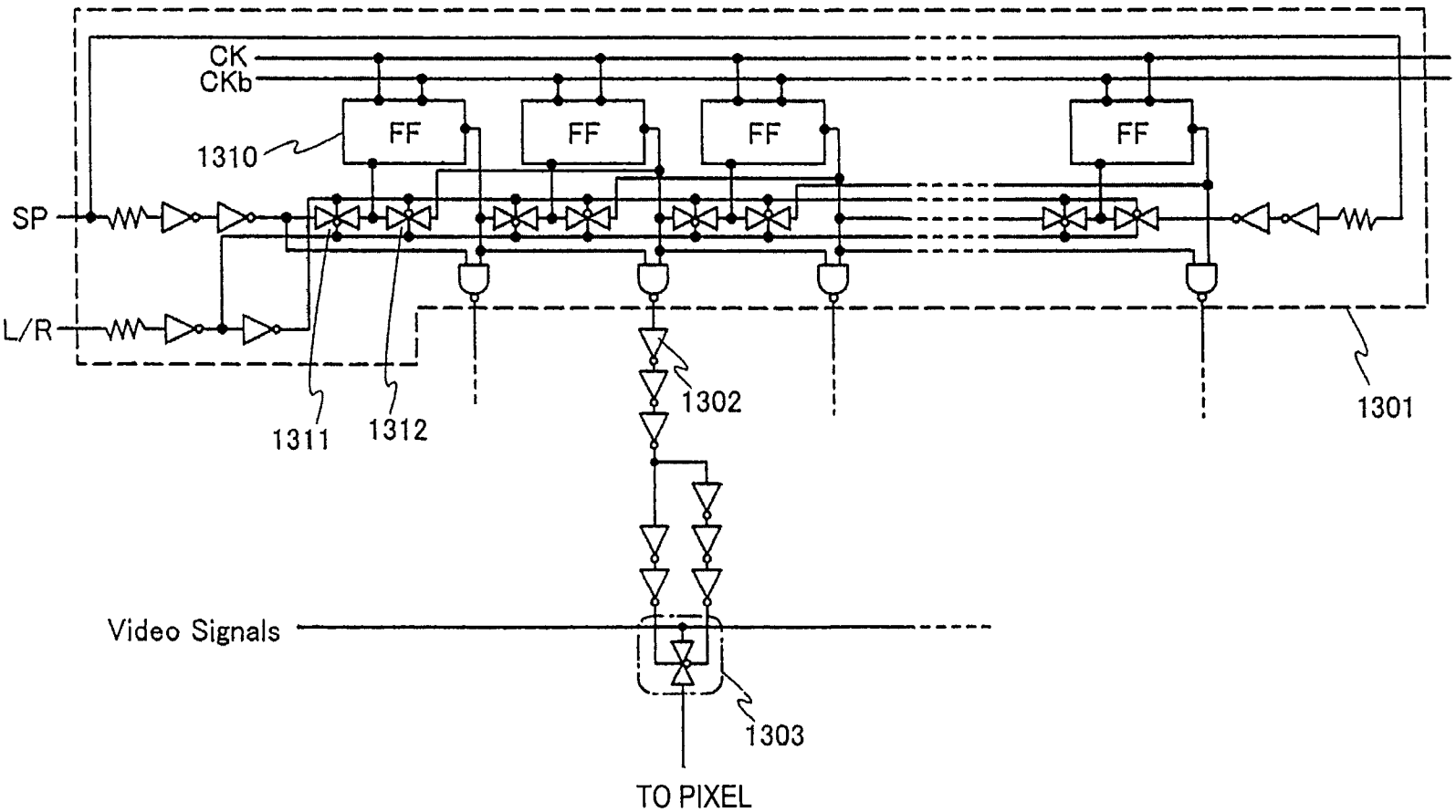
FIG. 9 is a diagram showing a configuration of a signal line driver circuit included in the light emitting device of the invention.

FIG. 9 is a circuit diagram of a signal line driver circuit included in the light emitting device of the invention, which is capable of switching an input sequence of a video signal to each pixel. In FIG. 9, reference numeral 1301 denotes a shift register which generates a timing signal for determining the sampling timing of a video signal by using a clock signal CK, an inverted clock signal CKb obtained by inverting the clock signal CK, and a start pulse signal SP.

The shift register 1301 comprises a plurality of flip flops 1310, and a plurality of pairs of transmission gates 1311 and 1312 each of which pairs corresponds to each of the flip flops 1310. The switching of the transmission gates 1311 and 1312 are controlled by a switching signal L/R so that when one of the transmission gates is turned ON, the other is turned OFF.

In the case where the transmission gate 1311 is turned ON, the start pulse signal is supplied to the most left flip flop 1310, thus the shift register 1301 functions from left to right. On the other hand, the transmission gate 1312 is turned ON, the start pulse signal is supplied to the most right flip flop 1310, thus the shift register 1301 functions from right to left.

The timing signal generated in the shift register 1301 is buffered and amplified in a plurality of inverters 1302 and transmitted to a transmission gate 1303. It is to be noted that only one circuit group (the inverter 1302 and the transmission gate 1303 here) preceded by an output of the shift register 1301 is shown in FIG. 9, though actually a plurality of circuit groups corresponding to the other outputs of the shift register are provided.

The switching of the transmission gate 1303 is controlled by the timing signal which has been buffered and amplified. When the transmission gate 1303 is turned ON, a video signal is sampled to be supplied to each pixel of a pixel portion. In the case where the shift register 1301 functions from left to right, the scan direction is also from left to right. Meanwhile, in the case where the shift register 1301 functions from right to left, the scan direction is also from right to left. Note that the transmission gate 1303 is not necessarily used, and other circuit such as a level shifter which functions as a switch may be used instead.

Figure 10:
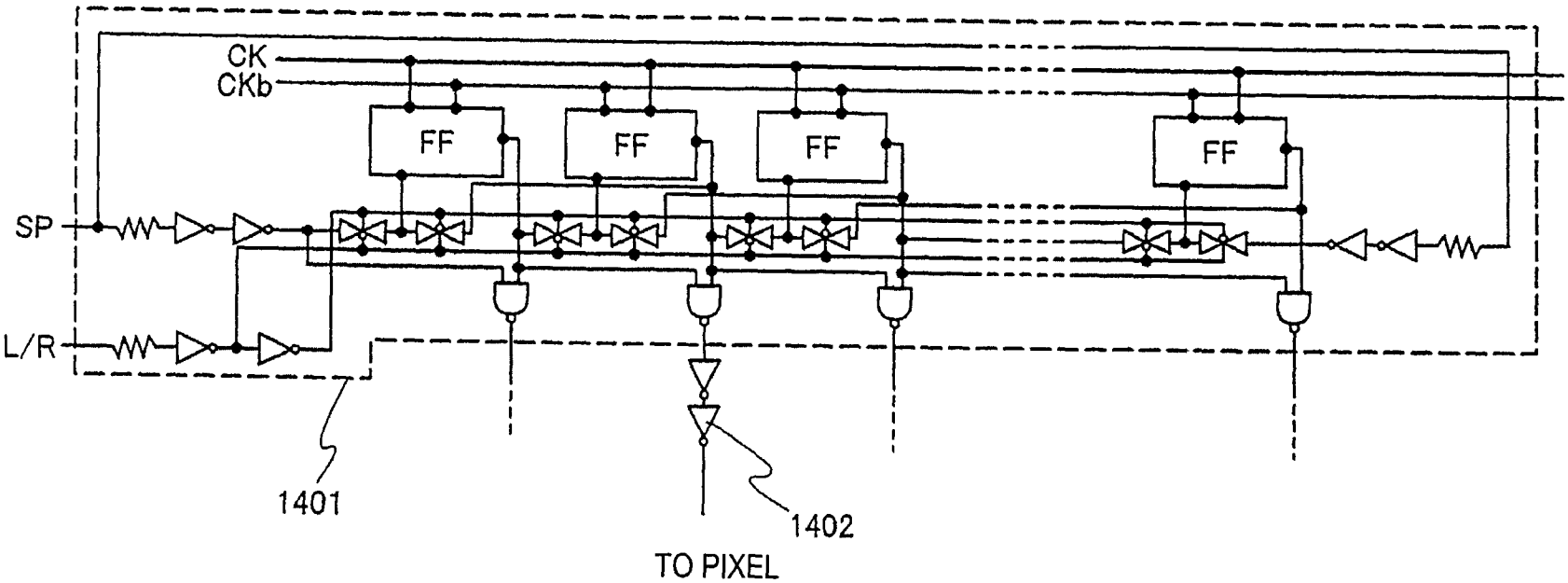
FIG. 10 is a diagram showing a configuration of a scan line driver circuit included in the light emitting device of the invention.

FIG. 10 is a circuit diagram of a first or a second scan line driver circuit of this embodiment. In FIG. 10, reference numeral 1401 denotes a shift register which has the same configuration as the shift register 1301 shown in FIG. 9, and the switching of the scan direction is controlled by a switching signal L/R. However, a timing signal generated in the shift register 1401 is used for selecting pixels in each row.

The timing signal generated in the shift register 1401 is buffered and amplified in an inverter 1402 and then inputted to a pixel. It is to be noted that only one circuit (the inverter 1402 here) preceded by an output of the shift register 1401 is shown in FIG. 10, though actually a plurality of circuits corresponding to other outputs of the shift register are provided.

The driver circuits shown in this embodiment are just examples applicable to the light emitting device of the invention, and the invention is not limited to these.

Embodiment 2

An example of a top plan view of the pixel shown in FIG. 1 is described hereinafter. In this embodiment, however, the places of the first switching transistor 102 and the second switching transistor 103 are exchanged.

Figure 11:
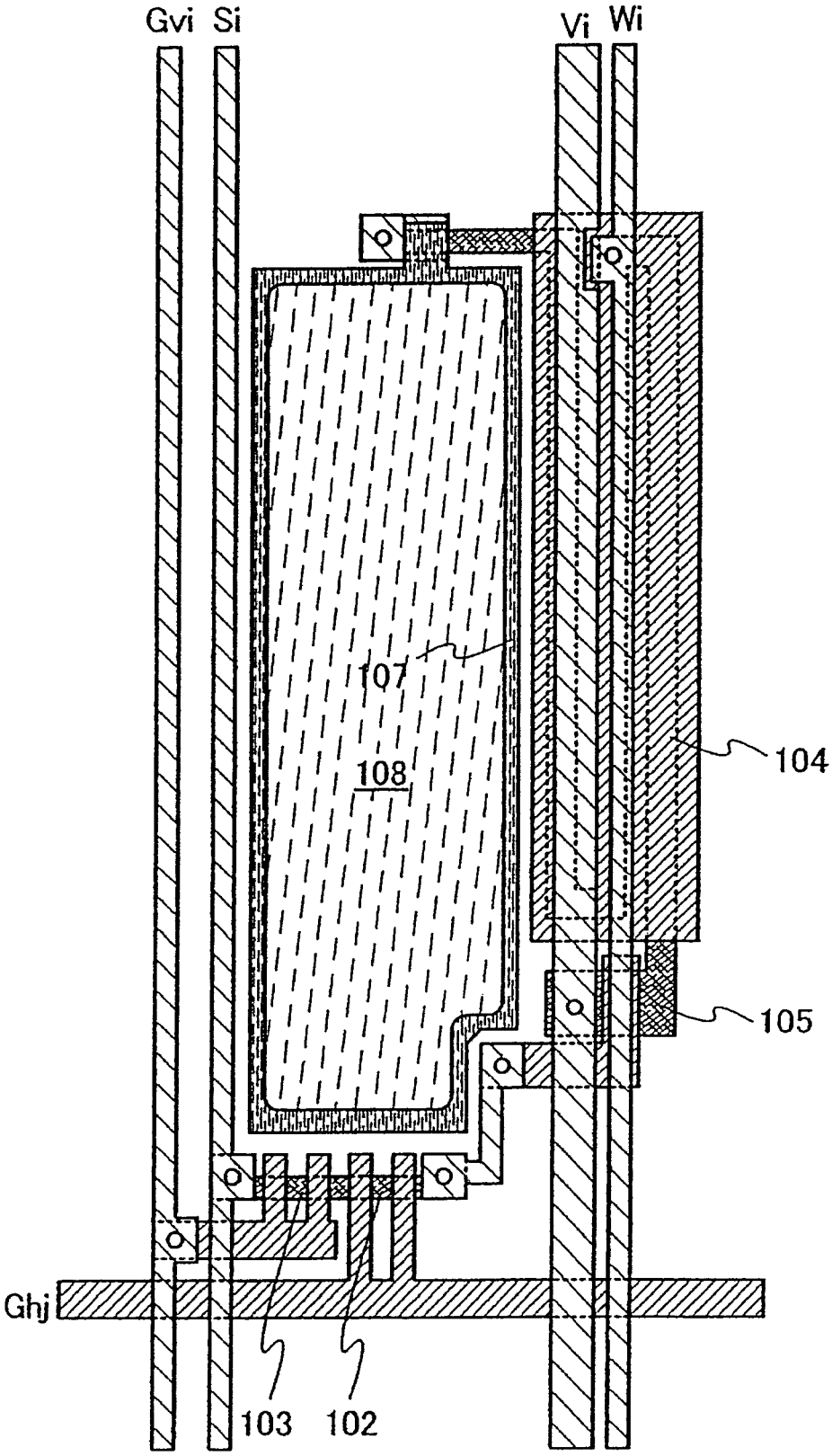
FIG. 11 is a top plan view of a pixel included in the light emitting device of the invention.

FIG. 11 is a top plan view of a pixel of this embodiment. In FIG. 11, Si is a signal line, Vi is a first power supply line, Wi is a second power supply line, Ghj is a first scan line, and Gvi is a second scan line. In this embodiment, the signal line Si, the first power supply line Vi, the second power supply line Wi, and the second scan line Gvi are formed of the same conductive layer. A part of the first scan line Ghj functions as a gate electrode of the first switching transistor 102. A gate electrode of the second switching transistor 103 is connected to the second scan line Gvi. An active layer of the driving transistor 104 has meander shape so that the ratio L/W thereof is larger than that of the current controlling transistor 105. Reference numeral 107 denotes a pixel electrode, and light is emitted in an overlapping area (a light emitting area) 108 of the pixel electrode 107 with an electro luminescent layer and a cathode (not shown).

Needless to say, the top plan view of this embodiment is just an example and the invention is not limited to this.

Embodiment 3

Described in this embodiment is an example of a structure of a light emitting element used in the light emitting device of the invention in the case of dual emission.

Figure 12A:
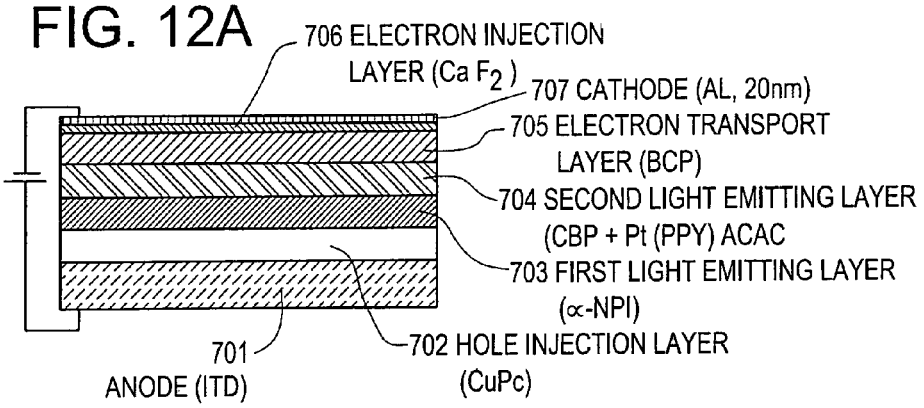
FIGS. 12A to 12C are cross sectional views of a light emitting element included in the light emitting device of the invention.

FIG. 12A is a pattern diagram showing a cross section of a light emitting element of this embodiment. In the light emitting element shown in FIG. 12A, an anode 701 formed of ITO which is a transparent conductive film, a hole injection layer 702 formed of copper phthalocyanine (CuPc), a first light emitting layer 703 formed of 4,4'-bis[N-(1-naphthyl)-N-phenyl-amino]-biphenyl (abbreviated to α-NPD), a second light emitting layer 704 formed of 4,4'-N,N'-dicarbazoril-biphenyl (abbreviated to CBP) which is to be a guest and Pt (ppy) acac which is to be a host, an electron transport layer 705 formed of bathocuproine (BCP), an electron injection layer 706 formed of $CaF_2$, and a cathode 707 formed of Al are laminated in this order. Note that, Pt (ppy) acac is represented by the structural formula shown below.

Structural Formula 1

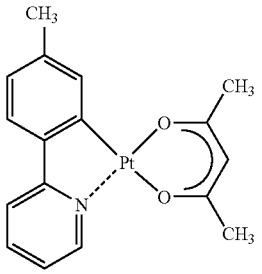

In this embodiment, the cathode 707 is formed thin enough to transmit light, specifically so as to have a thickness of about 20 nm, thereby realizing dual emission.

In the second light emitting layer 704 of the light emitting element shown in FIG. 12A, phosphorescence and excimer emission are both provided from a phosphorescent material when a phosphorous material CBP which is to be a guest is dispersed in a host material Pt (ppy) acac at a concentration of 10 wt % or more. Specifically, it is desirable that the phosphorescent material provides light emission having at least two peaks in a region of 500 to 700 nm, and either of the two peaks is the excimer emission. The first light emitting layer 703 provides blue light whose emission spectrum has the peak in a region of 400 to 500 nm, and when the blue emission is mixed with the light emission from the second light emitting layer 704, white emission having color purity more close to 0 can be achieved. Further, as only one kind of doping material is used, emission spectrum is not changed even when varying the current density or driving continuously, leading to stable supply of white emission. Note that, the first light emitting layer may be obtained by dispersing in a host material a guest material supplying blue light whose emission spectrum has the peak in a region of 400 to 500 nm.

Figure 12B:
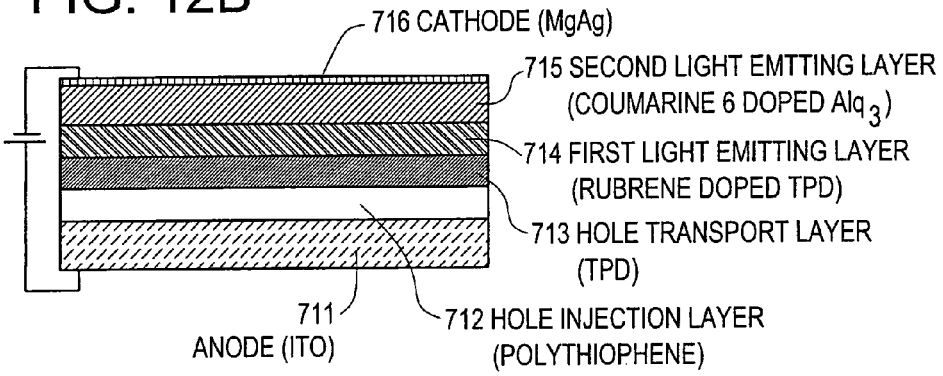

FIG. 12B is a pattern diagram showing a cross section of a light emitting element included in the light emitting device of the invention, which is different from the one shown in FIG. 12A. In the light emitting element shown in FIG. 12B, an anode 711 formed of ITO which is a transparent conductive film, a hole injection layer 712 formed of polythiophene, a hole transport layer 713 formed of N,N'-bis(3-methylphenyl)-N,N'-diphenyl-1,1'-biphenyl-4,4'-diamine (abbreviated to TPD), a first light emitting layer 714 formed of rubrene which is to be a guest and TPD which is to be a host, a second light emitting layer 715 formed of coumarin 6 which is to be a guest and $Alq_3$ which it to be a host, and a cathode 716 formed of MgAg are laminated in this order.

Similarly in FIG. 12B, the cathode 716 is formed thin enough to transmit light, specifically so as to have a thickness of about 20 nm, thereby realizing dual emission of white light.

Figure 12C:
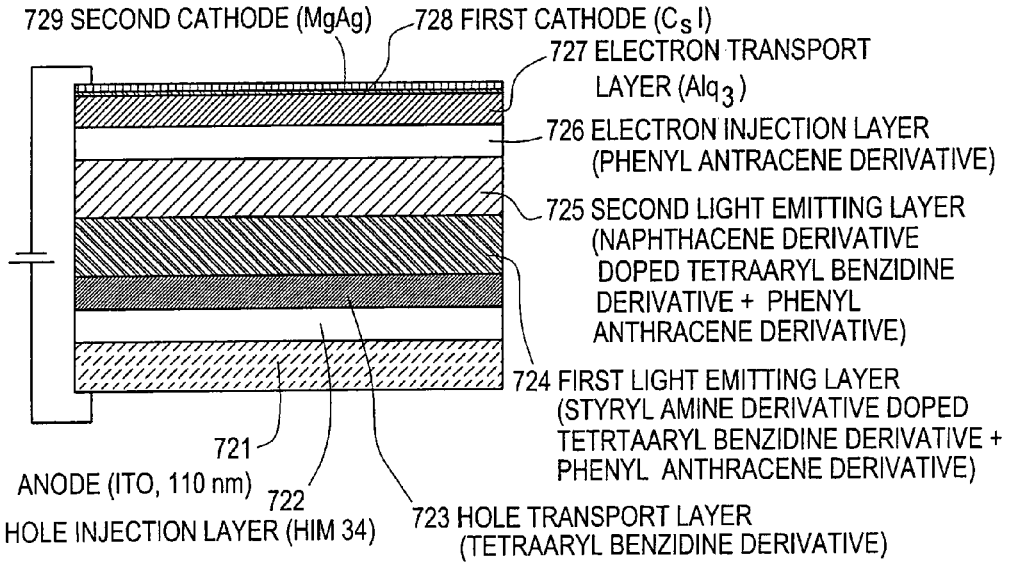

FIG. 12C is a pattern diagram showing a cross section of a light emitting element included in the light emitting device of the invention, which is different from the one shown in FIG. 12A. In the light emitting element shown in FIG. 12C, an anode 721 formed of ITO which is a transparent conductive film, a hole injection layer 722 formed of HIM34, a hole transport layer 723 formed of tetraaryl benzidine derivative, a first light emitting layer 724 formed of naphthacene derivative which is to be a guest and tetraaryl benzidine derivative and phenyl anthracene derivative which are to be hosts, a second light emitting layer 725 formed of styryl amine derivative which is to be a guest and tetraaryl benzidine derivative and phenyl anthracene derivative which are to be hosts, an electron transport layer 726 formed of phenyl anthracene derivative, an electron injection layer 727 formed of $Alq_3$, a first cathode 728 formed of CsI, and a second cathode 729 formed of MgAg are laminated in this order.

Similarly in FIG. 12C, the first cathode 728 and the second cathode 729 are formed so that the total thickness is thin enough to transmit light, specifically about 20 nm, thereby realizing dual emission of white light.

It is to be noted that the laminated structure of the light emitting element is not limited to these shown in FIGS. 12A to 12C. In order to emit light from the cathode, ITO whose work function is made smaller by adding Li may be used instead of reducing the thickness of the cathode. In the invention, any structure of the light emitting element may be adopted as long as light is emitted from both the anode and the cathode.

Embodiment 4

Figure 13A:
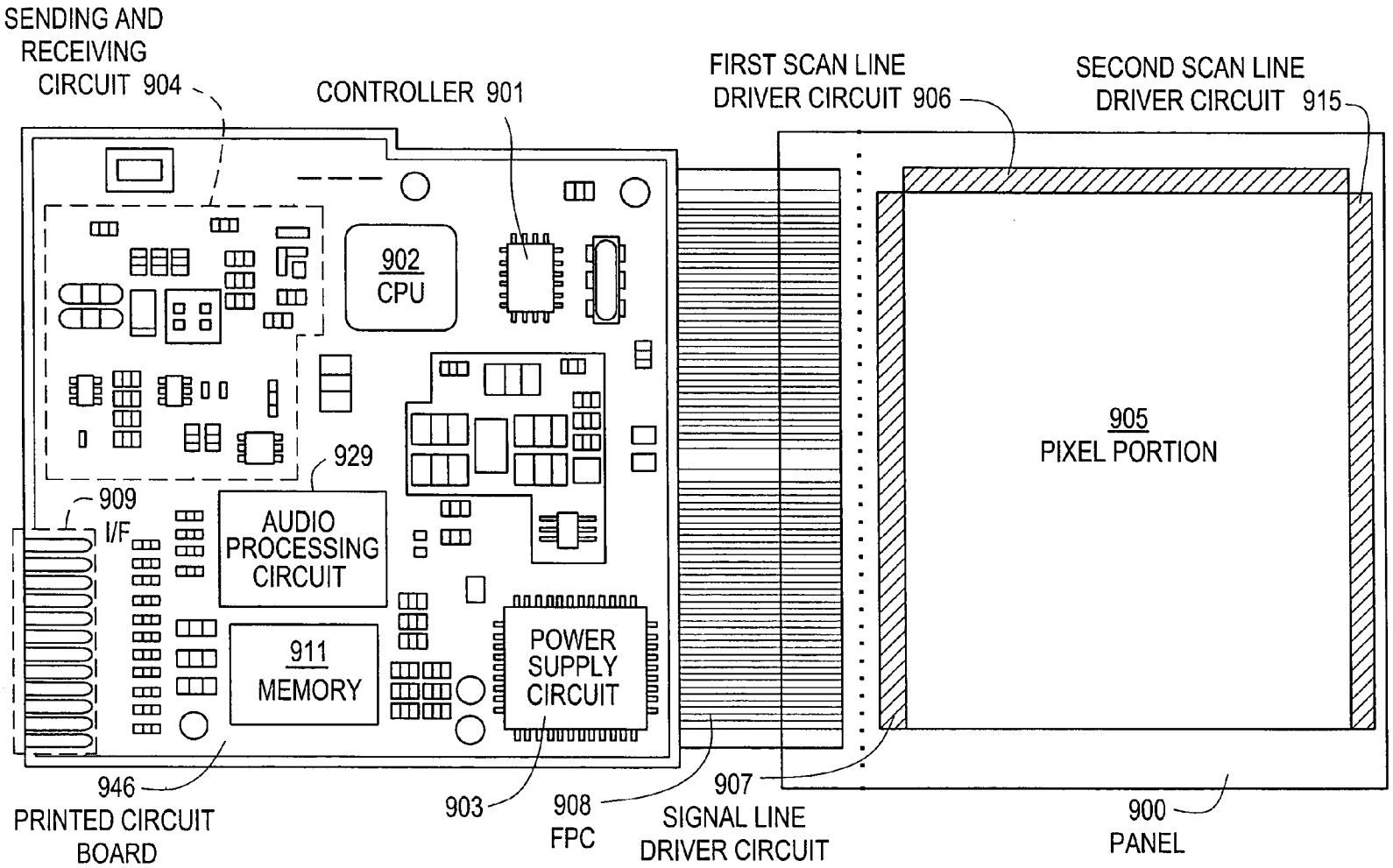
FIGS. 13A and 13B are diagrams showing a structure of a module of a light emitting device mounted in a mobile phone.

FIG. 13A shows an inside structure of a mobile phone which is one of the electronic apparatuses using the light emitting device of the invention. A module of the mobile phone shown in FIG. 13A comprises a printed circuit board 946. On the printed circuit board 946, a controller 901, a CPU 902, a memory 911, a power supply circuit 903, an audio processing circuit 929, and a sending and receiving circuit 904 are mounted as well as other components such as a resistor, a buffer, and a capacitor. Further, a panel 900 is connected to the printed circuit board 946 via an FPC 908. The panel 900 comprises a pixel portion 905 including pixels each provided with a light emitting element, a first scan line driver circuit 906 and a second scan line driver circuit 915 for selecting a pixel of the pixel portion 905, and a signal line driver circuit 907 for supplying a video signal to the selected pixel.

A power supply voltage and various signals inputted from a keyboard and the like are supplied to the printed circuit board 946 via an interface (I/F) 909 for printed circuit board having a plurality of input terminals. The printed circuit board 946 comprises also an antenna port 910 for transferring a signal to and from the antenna.

Although the panel 900 is connected to the printed circuit board 946 via the FPC 908 in this embodiment, the invention is not exclusively limited to this structure. The controller 901, the audio processing circuit 929, the memory 911, the CPU 902, and the power supply circuit 903 may be mounted directly on the panel 900 by COG (Chip On Glass).

In the printed circuit board 946, noises may occur in a power supply voltage and a signal, or a rising edge of a signal may be rounded due to a capacitance between lead wirings, resistance of the wiring itself and the like. Thus, components such as a capacitor and a buffer may be provided on the printed circuit board 946 in order to prevent noises from occurring in a power supply voltage and a signal or prevent a rising edge of a signal from being rounded.

Figure 13B:
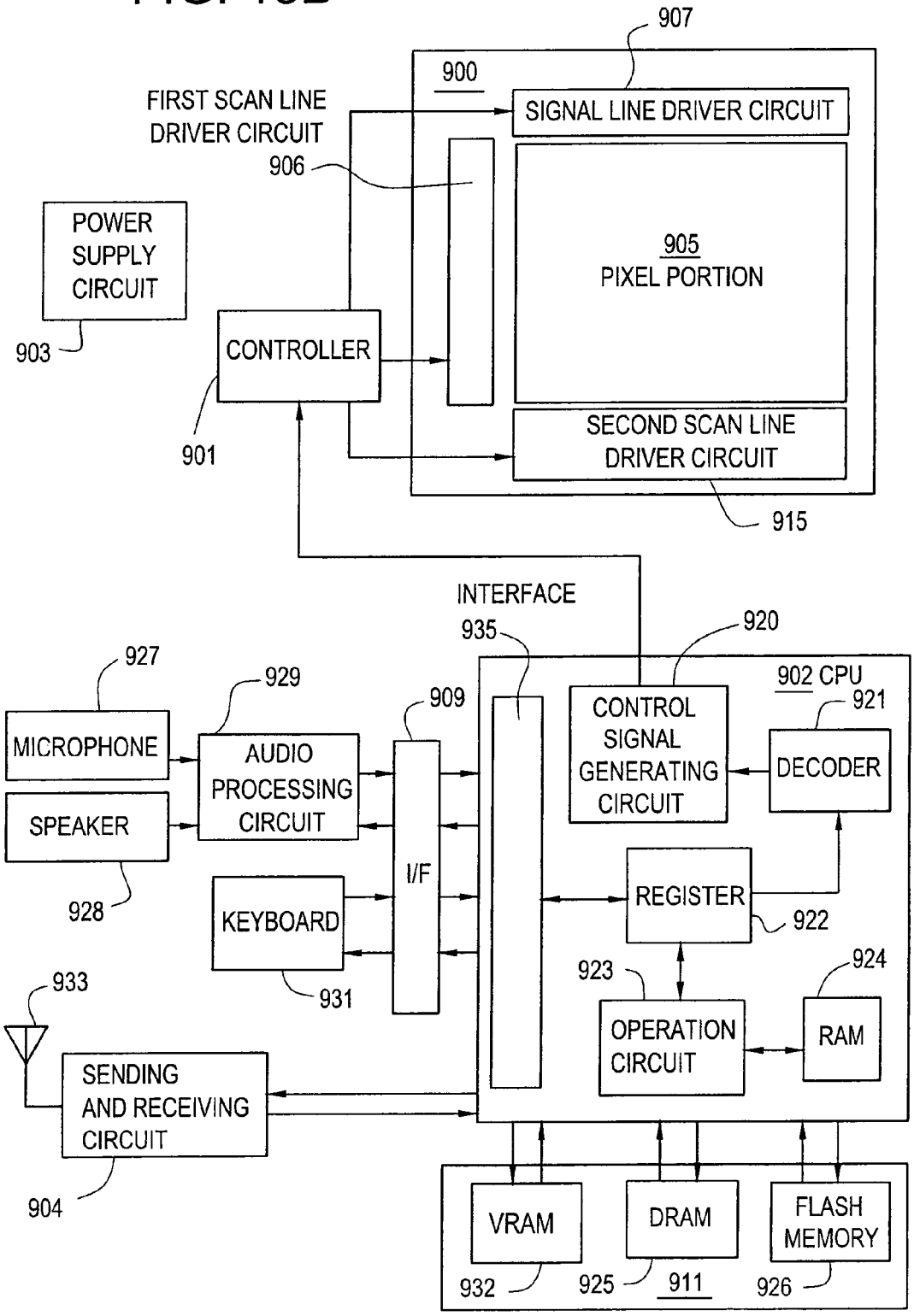

FIG. 13B is a block diagram of the module shown in FIG. 13A.

In this embodiment, the memory 911 includes a VRAM 932, a DRAM 925, a flash memory 926 and the like. The VRAM 932 stores image data to be displayed on the panel, the DRAM 925 stores image data or audio data, and the flash memory 926 stores various types of programs.

The power supply circuit 903 generates a power supply voltage supplied to the panel 900, the controller 901, the CPU 902, the audio processing circuit 929, the memory 911, and the sending and receiving circuit 904. Depending on the panel specification, the power supply circuit 903 may have a current source.

The CPU 902 includes a control signal generating circuit 920, a decoder 921, a register 922, an operation circuit 923, a RAM 924, an interface 935 for CPU and the like. Each signal inputted to the CPU 902 via the interface 935 is temporarily stored in the register 922, and then inputted to the operation circuit 923, the decoder 921 and the like. In the operation circuit 923, an operation is carried out in accordance with the inputted signal and the location to be sent each instruction is addressed. Meanwhile, the signal inputted to the decoder 921 is decoded and inputted to the control signal generating circuit 920. The control signal generating circuit 920 generates signals including various instructions in accordance with the inputted signal, and sends the signals to the location addressed by the operation circuit 923, specifically to the memory 911, the sending and receiving circuit 904, the audio processing circuit 929, the controller 901 and the like.

The memory 911, the sending and receiving circuit 904, the audio processing circuit 929, and the controller 901 are operated in accordance with a received instruction. Their operations are briefly described hereinafter.

A signal inputted from a keyboard 931 is sent to the CPU 902 mounted on the printed circuit board 946 via the interface 909. The control signal generating circuit 920 converts image data stored in the VRAM 932 into the predetermined format depending on a signal from the keyboard 931, and then sends it to the controller 901.

The controller 901 performs the processing of the signal including image data which has been sent from the CPU 902 in accordance with the panel specification, and supplies the signal to the panel 900. Further, the controller 901 generates an Hsync signal, a Vsync signal, a clock signal CLK, an AC voltage (AC cont), and a switching signal L/R in accordance with the power supply voltage inputted from the power supply circuit 903 and with each signal inputted from the CPU 902, and then supplies these signals to the panel 900.

A signal is sent and received as radio wave in an antenna 933, and it is processed in the sending and receiving circuit 904. Specifically, the sending and receiving circuit 904 includes high frequency circuits such as an isolator, a band pass filter, a VCO (Voltage Controlled Oscillator), an LPF (Low Pass Filter), a coupler, and a balun. Among the signals sent and received in the sending and receiving circuit 904, a signal including audio data is sent to the audio processing circuit 929 in accordance with an instruction from the CPU 902.

The signal including audio data which has been sent depending on an instruction from the CPU 902 is demodulated into an audio signal in the audio processing circuit 929, and then sent to a speaker 929. Meanwhile, an audio signal which has been sent from a microphone 927 is modulated in the audio processing circuit 929, and then sent to the sending and receiving circuit 904 in accordance with an instruction from the CPU 902.

The controller 901, the CPU 902, the power supply circuit 903, the audio processing circuit 929, and the memory 911 can be mounted as a package of the invention. The invention can be applied to any circuit other than high frequency circuits such as an isolator, a band pass filter, a VCO (Voltage Controlled Oscillator), an LPF (Low Pass Filter), a coupler, and a balun.

Embodiment 5

The light emitting device of the invention can be applied to various types of electronic apparatuses. In particular, it is quite useful to apply the light emitting device of the invention to a portable electronic apparatus whose usability is drastically improved by increasing the screen size while reducing the weight and size of the apparatus. The light emitting device of the invention is applicable to electronic apparatuses such as a video camera, a digital camera, a goggle type display (head mounted display), a navigation system, an audio reproducing device (an in-car audio system, a component stereo and the like), a notebook personal computer, a game machine, a portable information terminal (a mobile computer, a mobile phone, a portable game machine, an electronic book and the like), and a device such as an image reproducing device provided with a recording medium (specifically, a DVD: Digital Versatile Disc and the like), which is capable of reproducing a recording medium and comprises a display for displaying the reproduced image. As an example of the electronic apparatuses using the invention, a mobile phone is shown in FIGS. 14A and 14B.

Figure 14A:
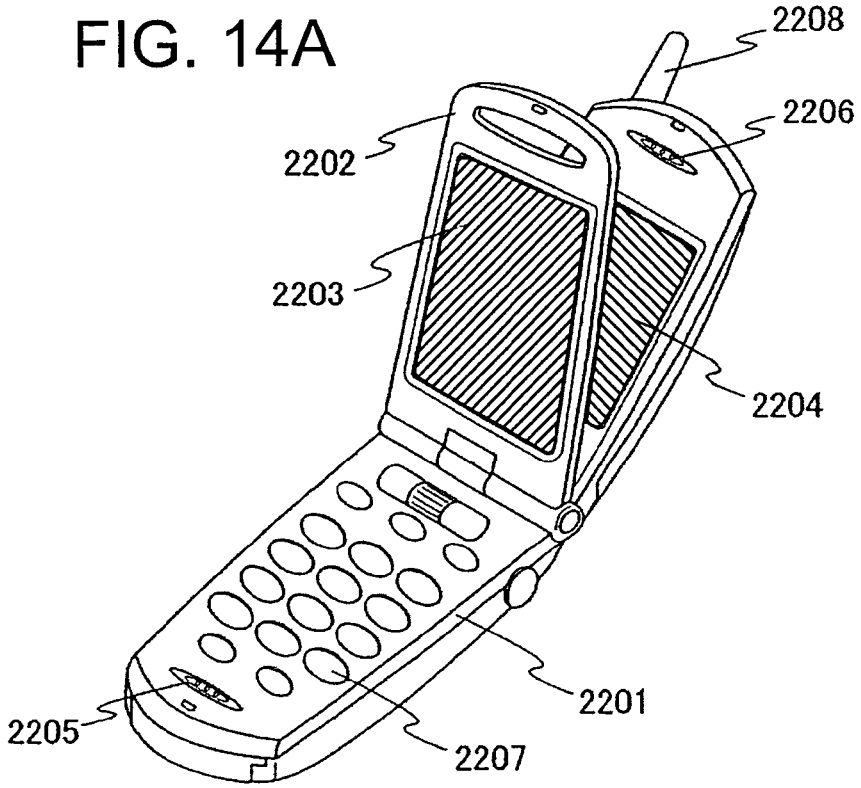
FIGS. 14A and 14B show electronic apparatuses using the light emitting device of the invention.

FIG. 14A shows a mobile phone which includes a main body 2201, a housing 2202, display portions 2203 and 2204, an audio input portion 2205, an audio output portion 2206, an operation key 2207, an antenna 2208 and the like. In FIG. 14A, the dual emission display device of the invention can be applied to the display portion 2203.

Figure 14B:
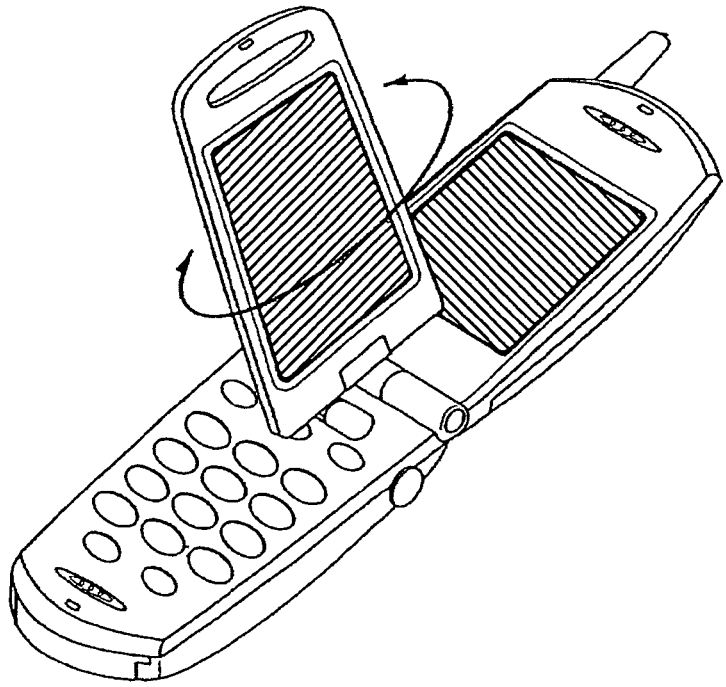

FIG. 14B shows the mobile phone shown in FIG. 14A, in which the display portion 2203 using the dual emission display device of the invention is rotated to the direction shown by an arrow and the image direction is switched vertically to horizontally. The switching of a displayed image direction can be performed by providing a sensor in a hinge for connecting the display portion 2203 and the main body 2201, and controlling an operation of a signal line driver circuit or a scan line driver circuit of the display device by using the sensor.

Figure 15A:
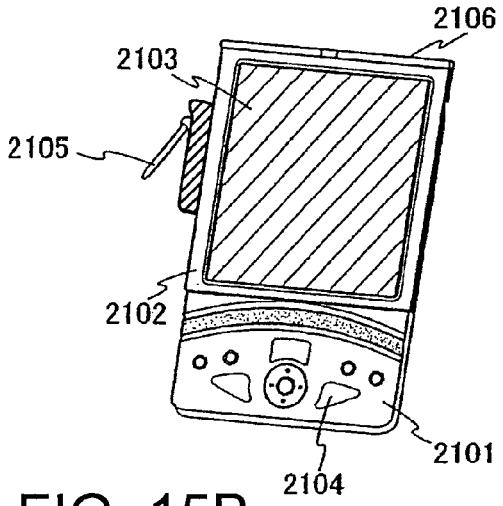
FIGS. 15A to 15C show portable information terminals to which the invention can be applied.
Figure 15B:
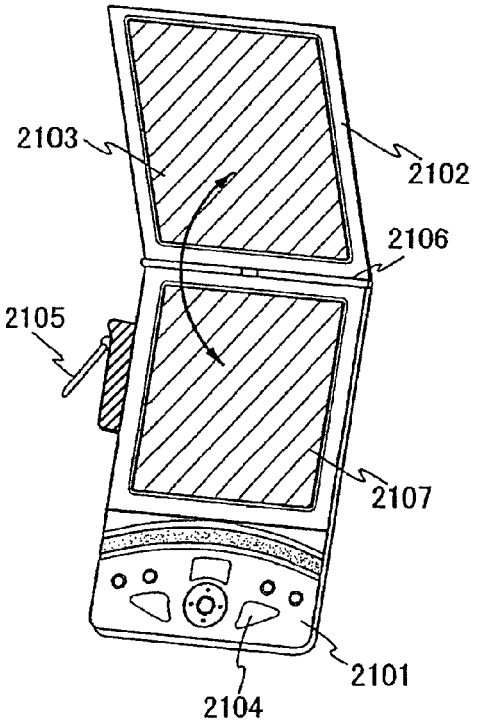

FIG. 15A shows a portable information terminal (PDA) which includes a main body 2101, a housing 2102, a display portion 2103, an operation key 2104, an antenna 2105 and the like. The dual emission display device of the invention is applied to the display portion 2103 of the portable information terminal shown in FIG. 15A. When the housing 2102 is rotated along a hinge 2106 as shown in FIG. 15B, the other surface of the display portion 2103 can be seen. A display portion 2107 using another light emitting device may be provided in an overlapping area of the main body 2101 and the housing 2102.

Figure 15C:
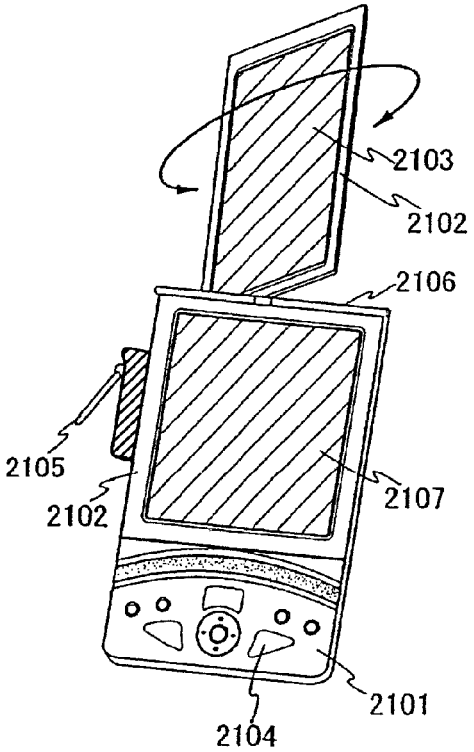

Further, as shown in FIG. 15C, the display portion 2103 may be rotated along an axis of rotation which is perpendicular to the axis of rotation shown in FIG. 15B.

As set forth above, the application range of the invention is so wide that it can be applied to electronic apparatuses in all fields. The light emitting device used for the electronic apparatuses described in this embodiment may have any one of configurations shown in Embodiments 1 to 4.

Embodiment 6

Figure 16:
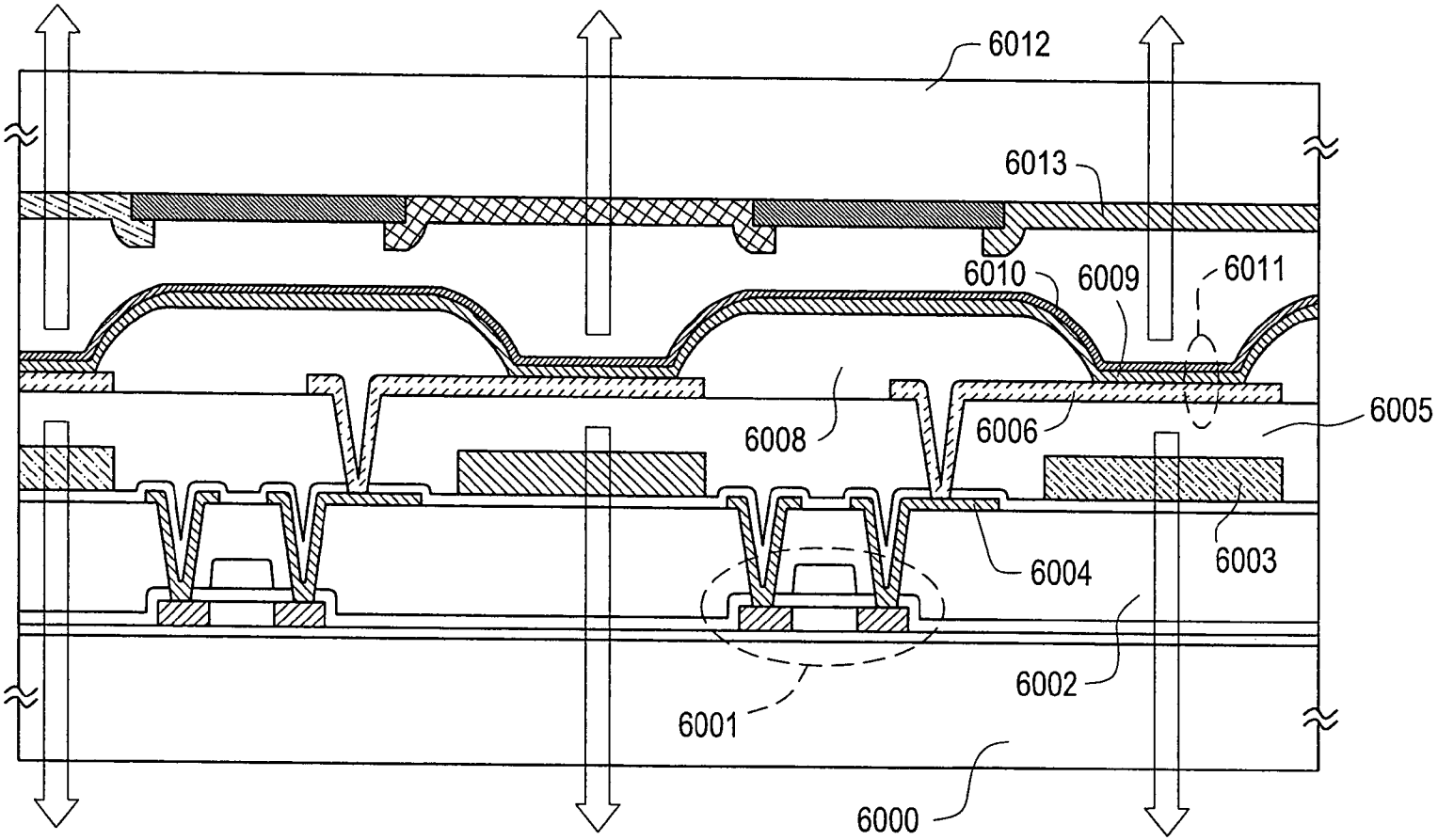
FIG. 16 is a cross sectional view of a pixel included in the light emitting device of the invention.

With reference to FIG. 16, a cross sectional structure of a pixel included in the light emitting device of the invention is explained. In FIG. 16, a transistor 6001 is formed over a substrate 6000. The transistor 6001 is covered with a first interlayer insulating film 6002, and over the first interlayer insulating film 6002, a color filter 6003 formed of a resin and the like and a wiring 6004 electrically connected to the transistor 6001 through a contact hole are formed.

A second interlayer insulating film 6005 is formed over the first interlayer insulating film 6002 so as to cover the color filter 6003 and the wiring 6004. For the first interlayer insulating film 6002 or the second interlayer insulating film 6005, a silicon oxide film, a silicon nitride film, or a silicon oxynitride film is formed to be a single layer or a plurality of layers by plasma CVD or sputtering. Alternatively, a silicon oxynitride film having a higher molar ratio of oxygen to nitrogen may be laminated on a silicon nitride oxide film having a higher molar ratio of nitrogen to oxygen in order to form the first interlayer insulating film 6002 or the second interlayer insulating film 6005. An organic resin film may also be used for the first interlayer insulating film 6002 or the second interlayer insulating film 6005.

A wiring 6006 is formed on the second interlayer insulating film 6005 and electrically connected to the wiring 6004 through a contact hole. A part of the wiring 6006 functions as an anode of a light emitting element. The wiring 6006 is formed so as to overlap with the color filter 6003 with the second interlayer insulating film 6005 interposed therebetween.

Over the second interlayer insulating film 6005, an organic resin film 6008 used as a bank is formed. The organic resin film 6008 comprises an opening portion, and the wiring 6006 serving as an anode, an electro luminescent layer 6009, and a cathode 6010 are overlapped with each other in the opening portion to form a light emitting element 6011. The electro luminescent layer 6009 is formed of a single light emitting layer or a plurality of laminated layers including a light emitting layer. It is to be noted that a protective layer may be provided over the organic resin film 6008 and the cathode 6010. In this case, the protective layer is formed of a film which transmits a substance such as moisture and oxygen with difficulty as compared with other insulating films in order to prevent such a substance from being absorbed in the light emitting element and accelerating deterioration of the light emitting element. Typically, for example, a DLC film, a carbon nitride film, a silicon nitride film formed by RF sputtering are desirably used. It is also possible to use for the protective layer a laminated layer of a layer which transmits the moisture, the oxygen and the like with difficulty and a layer which transmits the moisture, the oxygen and the like with ease.

The organic resin film 6008 is heated in a vacuum atmosphere in order to remove absorbed moisture and oxygen before forming the electro luminescent layer 6009. Specifically, heat treatment is applied in a vacuum atmosphere, at a temperature of from 100 to 200° C. and for approximately 0.5 to 1 hour. The vacuum is desirably set at $3\times10^{-7}$ Torr or less, and if possible at $3\times10^{-8}$ Torr or less. In the case where the electro luminescent layer 6009 is formed after applying the heat treatment to the organic resin film 6008 in the vacuum atmosphere, the reliability can be further improved by maintaining the electro luminescent layer 6009 in the vacuum atmosphere until immediately before the deposition.

End potions of the opening portion of the organic resin film 6008 are preferably formed to be roundish. According to this, the electro luminescent layer 6009 overlapped partly with the organic resin film 6008 can be prevented from being broken at the end portions. Specifically, a radius of curvature of a curve which is drawn by a cross section of the organic resin film in the opening portion is desirably in the range of 0.2 to 2 μm approximately.

According to the aforementioned structure, the coverage of an electro luminescent layer and a cathode which are formed later can be improved, and the wiring 6006 and the cathode 6010 can be inhibited from being short circuited in a hole formed in the electro luminescent layer 6009. Moreover, by alleviating the stress of the electro luminescent layer 6009, a defect called shrink in which a light emitting region is diminished can be suppressed and thus, the reliability can be enhanced.

In FIG. 16, a positive working photosensitive acryl resin is used as the organic resin film 6008. The photosensitive organic resin includes a positive type in which a portion exposed with an energy beam such as light, electrons, and ions is removed, and a negative type in which the exposed portion remains. In the invention, a negative working organic resin film may be used as well. Also, the organic resin film 6008 may be formed using photosensitive polyimide. When forming the organic resin film 6008 by using negative working acryl, a sectional shape of the end portions of the opening portion has an S-like shape. At this time, a radius of curvature at the upper and the lower end portions of the opening portion is desirably in the range of 0.2 to 2 μm.

The wiring 6006 may be formed of a transparent conductive film provided by mixing 2 to 20% of zinc oxide (ZnO) with indium oxide as well as ITO. In FIG. 16, the ITO is used for the wiring 6006. The surface of the wiring 6006 may be polished by CMP and cleaned by a swab using a polyvinyl alcohol porous body to be flat. After rubbing it by CMP, irradiation of UV rays, oxygen plasma processing and the like may be performed to polish the surface of the wiring 6006.

The cathode 6010 is formed thin enough to transmit light, and may be formed of any one of known conductive layers with a small work function, preferably using a material such as Ca, Al, CaF, MgAg and AlLi. It is to be noted that in order to emit light from the cathode, ITO whose work function is made smaller by adding Li may be used instead of reducing the thickness of the cathode. In the invention, any structure of the light emitting element may be adopted as long as light is emitted from both the anode and the cathode.

Actually, when the pixel has been completed to the stage shown in FIG. 16, it is preferable that it is packaged with a light transmissive covering material 6012 or a protective film (laminated film, UV ray curable resin film and the like) whose air tight sealing characteristic is high and which has less amount of degassing so as not to be exposed to the atmosphere. At that time, the reliability of the OLED is enhanced when the inside of the covering material is filled with an inert atmosphere or a moisture absorption material (e.g., barium oxide) is disposed inside. Moreover in the invention, a color filter 6013 may be attached to the cover material 6012.

It is to be noted that the invention is not limited to the aforementioned manufacturing method, and can be formed by other known methods.

Embodiment 7

In general, transmittance of a color filter differs from color to color, and therefore, luminance of a light emitting element after transmitting the color filter differs from color to color. The luminance of each color required for obtaining white light is not necessarily equal, but it has to be adjusted in order to get balanced white light. In general, different power supply line potentials are supplied to each pixel for displaying different colors in order to get balanced white light.

In this embodiment, a different example from the one described above is explained, in which the same power supply line potential is supplied to all pixels of the light emitting device of the invention capable of performing full color display, and white light is balanced by using a shielding film capable of partly shielding light emitted from a light emitting element.

Figure 17:
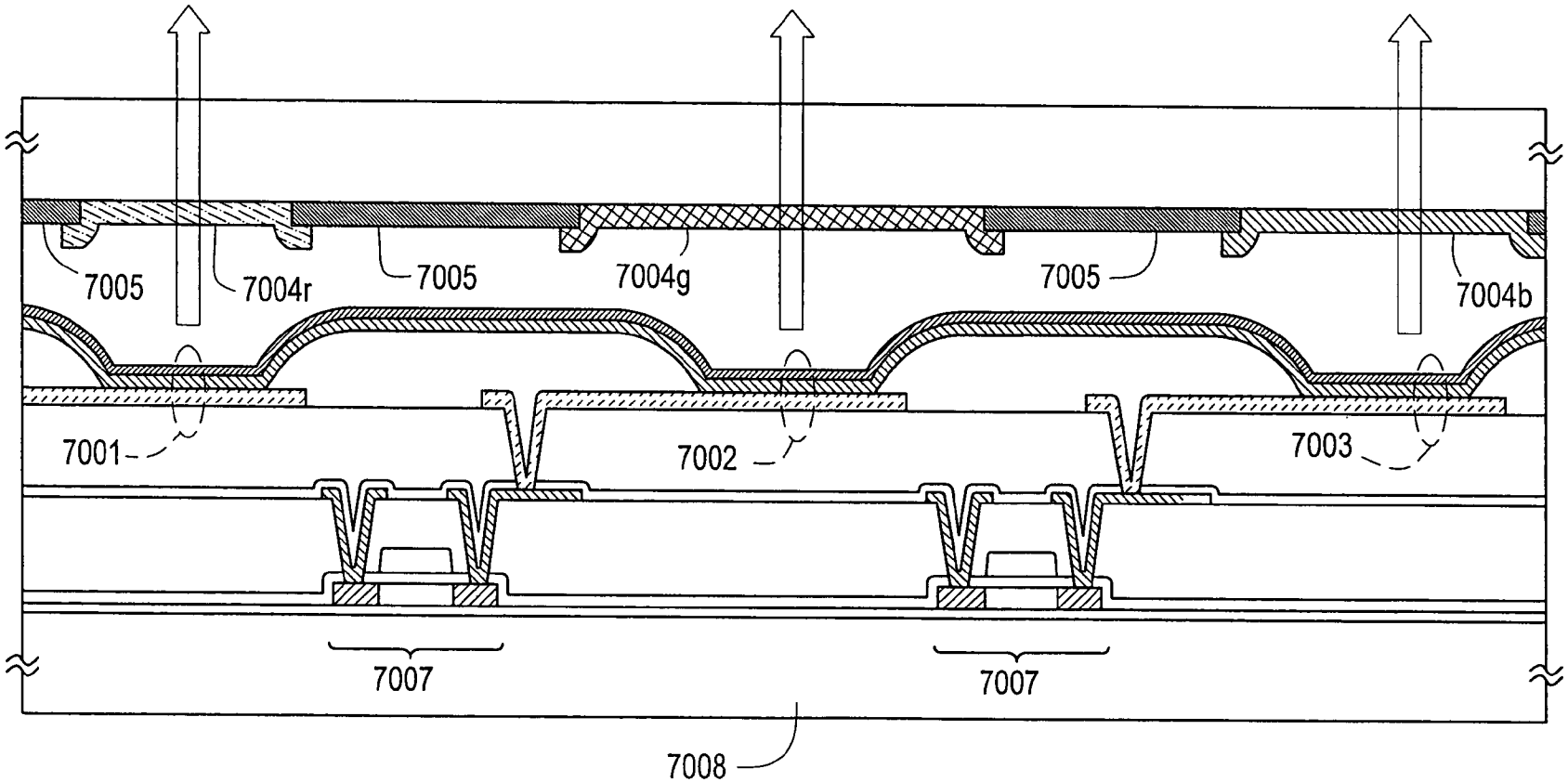
FIG. 17 is a cross sectional view of a pixel included in the light emitting device of the invention.

FIG. 17 is a cross sectional view of a pixel included in a light emitting device of this embodiment. Reference numerals 7001 to 7003 denote light emitting elements corresponding to a red (R) color filter 7004*r*, a green (G) color filter 7004*g*, and a blue color filter 7004*b*, respectively. The red (R) color filter 7004*r*, the green (G) color filter 7004*g*, and the blue color filter 7004*b* are separated from each other with shielding films 7005 interposed therebetween. The shielding films 7005 are provided for shielding light emitted from the light emitting elements 7001 to 7003. Accordingly, light emitted from the light emitting elements 7001 to 7003 are transmitted to the color filters 7004*r*, 7004*g*, and 7004*b*.

In this embodiment, light emitted from the light emitting elements 7001 to 7003 is turned to the opposite direction of a substrate 7008 on which TFTs 7007 are formed. Therefore, the color filters 7004*r*, 7004*g* and 7004*b*, and the shielding film 7005 are provided on the opposite side of the substrate 7008 with the light emitting elements 7001 to 7003 interposed therebetween. The invention, however, is not limited to this structure, and light emitted from the light emitting elements 7001 to 7003 may be turned to the direction of the substrate 7008. In such a case, the color filters 7004*r*, 7004*g* and 7004*b*, and the shielding film 7005 are provided on the side to which light from the light emitting elements 7001 to 7003 is emitted.

In this embodiment, layout of the shielding films 7005 is adjusted to change the area to which light is transmitted in each of the color filters 7004*r*, 7004*g* and 7004*b*. Specifically, the layout of the shielding films 7005 is adjusted so as to make a color filter required to have a higher luminance larger and make a color filter required to have a lower luminance smaller. According to the aforementioned structure, the luminance of each color can be adjusted without changing the current density of the light emitting element, and white light can be balanced without increasing the number of power supply lines.

Although the light emitting device shown in FIG. 17 performs full color display by using white light emitting elements in combination with color filters, the light emitting device of the invention is not exclusively limited to this structure. In the case of using light emitting elements corresponding to each of RGB, full color display can be achieved by supplying the same power supply line potential to all pixels of the light emitting element. Specifically, light is transmitted to a smaller area of a shielding film corresponding to a light emitting element required to have a low luminance, and light is transmitted to a larger area of a shielding film corresponding to a light emitting element required to have a high luminance. Thus, luminance of the light emitting elements corresponding to each color can be adjusted. Similarly, when adopting the CCM method and supplying the same power supply line potential, white light can be balanced by controlling an area of a shielding film to which light is transmitted.

This application is based on Japanese Patent Application serial no. 2003-139457 filed in Japan Patent Office on 16th, May 2003, and Japanese Patent Application serial no. 2003-157599 filed in Japan Patent Office on 3rd, Jun. 2003, the contents of which are hereby incorporated by reference.

Although the present invention has been fully described by way of Embodiment Modes and Embodiments with reference to the accompanying drawings, it is to be understood that various changes and modifications will be apparent to those skilled in the art. Therefore, unless such changes and modifications depart from the scope of the present invention hereinafter defined, they should be construed as being included therein.

What is claimed is:

1. A method for driving a light-emitting device comprising:

controlling input of a video signal from a signal line to at least one of pixels by both a signal provided on a first scan line oriented in a first scan direction and a signal provided on a second scan line oriented in a second scan direction, wherein the first scan direction intersects the second scan direction;

selecting whether a current is supplied to a light emitting element or not;

controlling a value of the current by a transistor; and supplying the current to the light emitting element, wherein a gate of the transistor is directly connected to a power supply line, wherein a part of the power supply line is provided in one of the pixels, wherein the signal line is provided in parallel with the part of the power supply line, and wherein the light emitting element comprises an anode, a cathode, and an electro luminescent layer provided between the anode and the cathode.

2. A method for driving a light-emitting device according to claim 1 wherein the light-emitting device is incorporated into one selected from the group consisting of a mobile phone and a portable information terminal.

3. A method for driving a light-emitting device according to claim 1 wherein the anode comprises ITO.

4. A method for driving a light-emitting device according to claim 1 wherein the cathode comprises a material selected from the group consisting of Ca, Al, CaF, MgAg and AlLi and is thin enough to transmit light.

5. A method for driving a light-emitting device according to claim 1 wherein the cathode comprises ITO doped with Li.

6. A method for driving a light-emitting device according to claim 1 wherein the anode comprises zinc oxide mixed with indium oxide.

7. A method for driving a light-emitting device according to claim 1 wherein the anode is a light transmissive anode, and the cathode is a light transmissive cathode.

8. A method for driving a light-emitting device according to claim 7 wherein the light transmissive cathode comprises a first cathode comprising CsI and a second cathode comprising MgAg and is thin enough to transmit light.

9. A method for driving a light-emitting device comprising:

controlling input of a video signal from a signal line to at least one of pixels by both a signal provided on a first scan line oriented in a first scan direction and a signal provided on a second scan line oriented in a second scan direction, wherein the first scan direction intersects the second scan direction;

selecting whether a current is supplied to a light emitting element or not;

controlling a value of the current; and supplying the current to the light emitting element, wherein the controlling of the value of the current is effected by a transistor operating in a saturation region, wherein a gate of the transistor is directly connected to a power supply line, wherein a part of the power supply line is provided in one of the pixels, wherein the signal line is provided in parallel with the part of the power supply line, and wherein the light emitting element comprises an anode, a cathode, and an electro luminescent layer provided between the anode and the cathode.

10. A method for driving a light-emitting device according to claim 9 wherein the light-emitting device is incorporated into one selected from the group consisting of a mobile phone and a portable information terminal.

11. A method for driving a light-emitting device according to claim 9 wherein the anode comprises ITO.

12. A method for driving a light-emitting device according to claim 9 wherein the cathode comprises a material selected from the group consisting of Ca, Al, CaF, MgAg and AlLi and is thin enough to transmit light.

13. A method for driving a light-emitting device according to claim 9 wherein the cathode comprises ITO doped with Li.

14. A method for driving a light-emitting device according to claim 9 wherein the anode comprises zinc oxide mixed with indium oxide.

15. A method for driving a light-emitting device according to claim 9 wherein the anode is a light transmissive anode, and the cathode is a light transmissive cathode.

16. A method for driving a light-emitting device according to claim 15 wherein the light transmissive cathode comprises a first cathode comprising CsI and a second cathode comprising MgAg and is thin enough to transmit light.

17. A method for driving a light-emitting device comprising:

controlling input of a video signal from a signal line to at least one of pixels by both a signal provided on a first scan line oriented in a first scan direction and a signal provided on a second scan line oriented in a second scan direction, wherein the first scan direction intersects the second scan direction;

selecting whether a current is supplied to a light emitting element or not;

controlling a value of the current; and supplying the current to the light emitting element with the value of the current controlled, wherein the selection is effected by a first transistor operating in a linear region, wherein the controlling of the value of the current is effected by a second transistor operating in a saturation region, wherein a gate of the second transistor is directly connected to a power supply line, wherein a part of the power supply line is provided in one of the pixels, wherein the signal line is provided in parallel with the part of the power supply line, and wherein the light emitting element comprises an anode, a cathode, and an electro luminescent layer provided between the anode and the cathode.

18. A method for driving a light-emitting device according to claim 17 wherein the light-emitting device is incorporated into one selected from the group consisting of a mobile phone and a portable information terminal.

19. A method for driving a light-emitting device according to claim 17 wherein the anode comprises ITO.

20. A method for driving a light-emitting device according to claim 17 wherein the cathode comprises a material selected from the group consisting of Ca, Al, CaF, MgAg and AlLi and is thin enough to transmit light.

21. A method for driving a light-emitting device according to claim 17 wherein the cathode comprises ITO doped with Li.

22. A method for driving a light-emitting device according to claim 17 wherein the anode comprises zinc oxide mixed with indium oxide.

23. A method for driving a light-emitting device according to claim 17 wherein the anode is a light transmissive anode, and the cathode is a light transmissive cathode.

24. A method for driving a light-emitting device according to claim 23 wherein the light transmissive cathode comprises a first cathode comprising CsI and a second cathode comprising MgAg and is thin enough to transmit light.

25. A method for driving a light-emitting device comprising:

controlling input of a video signal from a signal line to at least one of pixels by both a signal provided on a first scan line oriented in a first scan direction and a signal provided on a second scan line oriented in a second scan direction, wherein the first scan direction intersects the second scan direction;

selecting whether a current is supplied to a light emitting element or not;

controlling a value of the current; and supplying the current to the light emitting element, wherein a first transistor operating in a linear region is connected in series with a second transistor, wherein the selection is effected by the first transistor, wherein a gate of the second transistor is directly connected to a power supply line, wherein a part of the power supply line is provided in one of the pixels, wherein the signal line is provided in parallel with the part of the power supply line, and wherein the light emitting element comprises an anode, a cathode, and an electro luminescent layer provided between the anode and the cathode.

26. A method for driving a light-emitting device according to claim 25 wherein the light-emitting device is incorporated into one selected from the group consisting of a mobile phone and a portable information terminal.

27. A method for driving a light-emitting device according to claim 25 wherein the anode comprises ITO.

28. A method for driving a light-emitting device according to claim 25 wherein the cathode comprises a material selected from the group consisting of Ca, Al, CaF, MgAg and AlLi and is thin enough to transmit light.

29. A method for driving a light-emitting device according to claim 25 wherein the cathode comprises ITO doped with Li.

30. A method for driving a light-emitting device according to claim 25 wherein the anode comprises zinc oxide mixed with indium oxide.

31. A method for driving a light-emitting device according to claim 25 wherein the anode is a light transmissive anode, and the cathode is a light transmissive cathode.

32. A method for driving a light-emitting device according to claim 31 wherein the light transmissive cathode comprises a first cathode comprising CsI and a second cathode comprising MgAg and is thin enough to transmit light.

33. A method for driving a light-emitting device comprising:

controlling input of a video signal from a signal line to at least one of pixels by both a signal provided on a first scan line oriented in a first scan direction and a signal provided on a second scan line oriented in a second scan direction, wherein the first scan direction intersects the second scan direction;

controlling a value of a current; and supplying the current to a light emitting element, wherein one of a source and a drain of a first transistor is connected with one of a source and a drain of a second transistor, wherein a gate of the second transistor is directly connected to a power supply line, wherein a part of the power supply line is provided in one of the pixels, wherein the signal line is provided in parallel with the part of the power supply line, wherein the controlling of the value of the current is effected by the second transistor operating in a saturation region, and wherein the light emitting element comprises an anode, a cathode, and an electro luminescent layer provided between the anode and the cathode.

34. A method for driving a light-emitting device according to claim 33 wherein the light-emitting device is incorporated into one selected from the group consisting of a mobile phone and a portable information terminal.

35. A method for driving a light-emitting device according to claim 33 wherein the anode comprises ITO.

36. A method for driving a light-emitting device according to claim 33 wherein the cathode comprises a material selected from the group consisting of Ca, Al, CaF, MgAg and AlLi and is thin enough to transmit light.

37. A method for driving a light-emitting device according to claim 33 wherein the cathode comprises ITO doped with Li.

38. A method for driving a light-emitting device according to claim 33 wherein the anode comprises zinc oxide mixed with indium oxide.

39. A method for driving a light-emitting device according to claim 33 wherein the anode is a light transmissive anode, and the cathode is a light transmissive cathode.

40. A method for driving a light-emitting device according to claim 39 wherein the light transmissive cathode comprises a first cathode comprising CsI and a second cathode comprising MgAg and is thin enough to transmit light.

* * * * *